US008315863B2

(12) United States Patent
Oshikiri

(10) Patent No.: US 8,315,863 B2
(45) Date of Patent: Nov. 20, 2012

(54) POST FILTER, DECODER, AND POST FILTERING METHOD

(75) Inventor: Masahiro Oshikiri, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1111 days.

(21) Appl. No.: 11/917,604

(22) PCT Filed: Jun. 15, 2006

(86) PCT No.: PCT/JP2006/312001

§ 371 (c)(1),
(2), (4) Date: Dec. 14, 2007

(87) PCT Pub. No.: WO2006/134992

PCT Pub. Date: Dec. 21, 2006

(65) Prior Publication Data

US 2009/0216527 A1 Aug. 27, 2009

(30) Foreign Application Priority Data

Jun. 17, 2005 (JP) ..... 2005-177781
May 30, 2006 (JP) ..... 2006-150356

(51) Int. Cl.
*G10L 21/02* (2006.01)

(52) U.S. Cl. ..... 704/228; 704/273; 704/262; 704/230; 704/229; 704/222; 704/219; 704/205; 704/203; 704/200.1; 375/346; 375/240.11; 370/352

(58) Field of Classification Search ..... 704/219, 704/205, 203, 230, 273, 262, 229, 222, 204, 704/200.1; 370/352; 375/240.11, 346
See application file for complete search history.

(56) References Cited

U.S. PATENT DOCUMENTS 5,473,727 A * 12/1995 Nishiguchi et al. ..... 704/222
5,517,595 A * 5/1996 Kleijn ..... 704/205
5,659,661 A 8/1997 Ozawa
5,717,724 A * 2/1998 Yamazaki et al. ..... 375/346
6,108,626 A * 8/2000 Cellario et al. ..... 704/230

(Continued)

FOREIGN PATENT DOCUMENTS

EP 0658875 6/1995

(Continued)

OTHER PUBLICATIONS

Fang-Ming Wang, "Frequency domain adaptive postfiltering for enhancement of noisy speech," Speech Communication, Elsevier Science Publishers, Amsterdam, NL, vol. 12, No. 1, Mar. 1993.

(Continued)

*Primary Examiner* — Michael Colucci
(74) *Attorney, Agent, or Firm* — Greenblum & Bernstein, P.L.C.

(57) ABSTRACT

A post filter and a decoder enabling improvement of the sound quality of a decoded signal even when the sound quality of the decoded signal is different from the bands are disclosed. A frequency converting section determines a decoded spectrum. A power spectrum computing section computes the power spectrum from the decoded spectrum. A correction band determining section determines the band in which the power spectrum is corrected according to layer information. A power spectrum correcting section corrects the power spectrum in the corrected band in such a way that the variation along the frequency axis is suppressed. An inverse converting section subjects the corrected power spectrum to inverse conversion to determine an autocorrelation function. An LPC analyzing section determines an LPC coefficient of the determined autocorrelation function.

15 Claims, 20 Drawing Sheets

U.S. PATENT DOCUMENTS

| | | | | |
|---|---|---|---|---|
| 6,504,838 | B1 * | 1/2003 | Kwan | 370/352 |
| 6,574,593 | B1 | 6/2003 | Gao et al. | |
| 6,658,378 | B1 * | 12/2003 | Maeda | 704/200.1 |
| 7,277,849 | B2 * | 10/2007 | Streich et al. | 704/229 |
| 7,565,296 | B2 * | 7/2009 | Oh | 704/273 |
| 7,668,712 | B2 * | 2/2010 | Wang et al. | 704/219 |
| 2002/0052736 | A1 * | 5/2002 | Kim et al. | 704/219 |
| 2003/0009326 | A1 * | 1/2003 | Wang et al. | 704/219 |
| 2003/0154074 | A1 * | 8/2003 | Kikuiri et al. | 704/219 |
| 2003/0187634 | A1 * | 10/2003 | Li | 704/200.1 |
| 2004/0019481 | A1 | 1/2004 | Saito | |
| 2004/0049379 | A1 * | 3/2004 | Thumpudi et al. | 704/205 |
| 2004/0068407 | A1 * | 4/2004 | Serizawa | 704/262 |
| 2004/0172241 | A1 * | 9/2004 | Mahe et al. | 704/205 |
| 2004/0184537 | A1 * | 9/2004 | Geiger et al. | 375/240.11 |
| 2005/0144006 | A1 * | 6/2005 | Oh | 704/273 |
| 2007/0100613 | A1 | 5/2007 | Yasunaga et al. | |
| 2007/0253481 | A1 | 11/2007 | Oshikiri | |
| 2007/0255558 | A1 | 11/2007 | Yasunaga et al. | |
| 2008/0249766 | A1 * | 10/2008 | Ehara | 704/203 |

FOREIGN PATENT DOCUMENTS

| | | |
|---|---|---|
| JP | 3-125586 | 5/1991 |
| JP | 7-160296 | 6/1995 |
| JP | 7160296 | 6/1995 |
| JP | 8-305397 | 11/1996 |
| JP | 9-326772 | 12/1997 |
| JP | 10-78797 | 3/1998 |
| JP | 11-112352 | 4/1999 |
| JP | 11-184500 | 7/1999 |
| JP | 2001-117573 | 4/2001 |
| JP | 2001-242899 | 9/2001 |
| JP | 2004-061617 | 2/2004 |
| JP | 2004-64190 | 2/2004 |
| JP | 2004-302257 | 10/2004 |
| JP | 2005-20241 | 1/2005 |
| JP | 2005-258226 | 9/2005 |
| WO | 2005/106848 | 11/2005 |

OTHER PUBLICATIONS

Search report from E.P.O. for EP 06766735, mail date is Nov. 29, 2010.

Japan Office action, mail date is Nov. 29, 2011.

English language Abstract of JP 7-160296, Jun. 23, 1995.

English language Abstract of JP 8-305397, Nov. 22, 1996.

English language Abstract of JP 10-78797, Mar. 24, 1998.

Oshikiri et al., "Shuhasu Ryoiki Rostfilter ni yoru Fugoka Onsei no Hinshitsu kaizen", The Acoustical Society of Japan (ASJ) 2004 Nen Shuki Kenkyu Happyokai Koen Ronbunshuu -I-, Mar. 45, 2000, pp. 249-250.

All about MPEG-4 (MPEG-4 no subete), the first edition, written edited Sukeichi Miki, kogyo chosakai publishing, Inc., Sep. 30, 1998, pp. 126-127.

Chen et al., "daptive Postfiltering for Quality Enhancement of Coded Speech," IEEE Trans. Speech and Audio Processing, vol. SAP-3, pp. 59-71, 1995.

* cited by examiner

| DEGREE OF POST FILTERING | |
|---|---|
| LOWER BAND | HIGHER BAND |
| NO | HIGH |

POST FILTER, DECODER, AND POST FILTERING METHOD

TECHNICAL FIELD

The present invention relates to a post filter, decoding apparatus and post filtering method for reducing quantization noise in the spectrum of a decoded signal obtained by decoding an encoded code to which a scalable coding scheme is applied.

BACKGROUND ART

A mobile communication system is required to compress a speech signal to a low bit rate and transmit the speech signal for effective use of radio resources. Further, improvement of communication speech quality and realization of a communication service of high actuality are demanded. To meet these demands, it is preferable to make quality of speech signals high and encode signals other than the speech signals, such as audio signals in wider bands, with high quality.

A technique for integrating a plurality of coding techniques in layers for these two contradicting demands is regarded as promising. This technique refers to integrating in layers the first layer where an input signal according to a model suitable for a speech signal is encoded at a low bit rate and the second layer where a differential signal between the input signal and the decoded signal of the first layer is encoded according to a model suitable for signals other than speech. According to such a layered coding technique, a bit stream obtained from an encoding apparatus includes scalability, that is, features of obtaining the decoded signal from a portion of information of the bit stream. Such technique is generally referred to as "scalable coding (layered coding or hierarchical coding)."

Based on these features, the scalable coding scheme can flexibly support communication between networks of different bit rates and is suitable for the network environment in the future where various networks are integrated through the IP protocol.

The technique disclosed in Non-Patent Document 1 is an example of realizing scalable coding using a standardized technique with MPEG-4 (Moving Picture Experts Group phase-4). This technique uses CELP (code excited linear prediction) coding suitable for speech signals in the first layer and uses transform coding such as AAC (advanced audio coder) and TwinVQ (transform domain weighted interleave vector quantization) for the residual signal obtained by removing the first layer decoded signal from the original signal in the second layer.

By the way, a post filter is known as an effective technique for improving speech quality of a decoded speech signal. Generally, when a speech signal is encoded at a low bit rate, quantization noise in the valley portion of the spectrum of a decoded signal is perceived. However, by applying the post filter, it is possible to reduce such quantization noise in the valley portion of the spectrum. As a result, the decoded signal becomes less noisy, and subjective quality improves. Transfer function PF(z) of a typical post filter is represented by following equation 1 by using formant emphasis filter F(z) and tilt compensation filter U(z) (see Non-Patent Document 2).

(Equation 1)

$$PF(z) = F(z) \cdot U(z) \quad [1]$$

$$\begin{cases} F(z) = \dfrac{1 - \sum_{i=1}^{NP} \alpha(i)\gamma_n^i z^{-i}}{1 - \sum_{i=1}^{NP} \alpha(i)\gamma_d^i z^{-i}} \\ U(z) = 1 - \mu \cdot z^{-1} \end{cases}$$

Here, $\alpha(i)$ is an LPC (linear predictive coding) coefficients, or linear prediction coefficients, of the decoded signal, NP is the order of the LPC coefficients, $\gamma_n$ and $\gamma_d$ are set values ($0<\gamma_n<\gamma_d<1$) for determining the degree for noise reduction by the post filter and p is a set value for compensating a spectral tilt generated by the formant emphasis filter.

Further, Patent Document 1 discloses a technique of calculating an auditory masking threshold value in the frequency domain from the decoded signal, and calculating the LPC coefficients used in the post filter from this auditory masking threshold value.

The post filter reduces the valley portion of the spectrum of the decoded signal as described above, so that it is possible to reduce noise in the decoded signal compressed and extended, through low bit rate coding and improve subjective quality. In other words, the post filter modifies the shape of the spectrum and further reduces noise.

Patent Document 1: Japanese Patent Application Laid-Open No. HEI7-160296

Non-Patent Document 1: "All about MPEG-4" (MPEG-4 no subete), the first edition, written and edited by Sukeichi MIKI, Kogyo Chosakai Publishing, Inc., Sep. 30, 1998, page 126 to 127.

Non-Patent Document 2: J.-H. Chen and A. Gersho, "Adaptive postfiltering for quality enhancement of coded speech," IEEE Trans. Speech and Audio Processing, vol. SAP-3, pp. 59-71, 1995.

DISCLOSURE OF INVENTION

Problems to be Solved by the Invention

However, when the post filter is applied to the decoded signal compressed and extended by a coding scheme of a relatively high bit rate, the shape of the spectrum of the decoded signal that needs not to be modified is modified and, on the contrary, subjective quality of the decoded signal is decreased. Hereinafter, this will be described in detail.

In scalable coding, speech quality of decoded signals is likely to vary between bands depending on layer configurations. "Speech quality" described above refer to subjective quality perceived by humans who hear sound or refers to objective quality such as the signal to noise ratio (SNR). Here, for example, scalable coding having the layer configuration shown in FIG. 1 will be discussed. In FIG. 1, the horizontal axis is the frequency, the vertical axis is speech quality and each layer supports a band and speech quality. In this case, layer 1 processes a lower band (where frequency k is equal to or more than 0 and less than FL) and a higher band (where frequency k is equal to or more than FL and less than FH) for standard quality, and layer 2 processes the lower band for improved quality. Further, layer 3 processes the higher band for improved quality.

If layer 3 is not used in decoding processing due to network traffic and the performance of equipment used, a decoded signal of improved quality is generated in the lower band and a decoded signal of standard quality is generated in the higher band, as shown in FIG. 2.

With the post filter disclosed in Patent Document 1 or Non-Patent Document 2, even though quality vary between bands in this way, the performance of the post filter is determined all the time according to a certain criterion. For this reason, for all of the band to which the post filter needs not to be applied, the band (the lower band in FIG. 2) to which the low degree of post filtering should be applied and the band (the higher band of FIG. 2) to which the high degree of post filtering should be applied, the characteristics of the post filter are determined according to a certain criterion all the time and, therefore the effect of improvement in speech quality by the post filter cannot be sufficiently obtained.

It is an object of the present invention to provide a post filter, decoding apparatus and post filtering method for, when speech quality of decoded signals vary between bands, improving speech quality of decoded signals.

Means for Solving the Problem

The post filter according to the present invention that reduces quantization noise in a decoded signal of a signal subjected to layered coding according to a coding scheme providing a plurality of layers, adopts a configuration including: a band determining section that determines a band where the decoded signal shows good speech quality; a spectrum correcting section that corrects a spectrum of the decoded signal in the determined band such that changes of the spectrum in the frequency domain are reduced; and a filter section that filters the decoded signal using a coefficient derived from the corrected spectrum.

The decoding apparatus according to the present invention that reduces quantization noise in a decoded signal of a signal subjected to layered coding according to a coding scheme providing a plurality of layers, adopts a configuration including: a band determining section that determines a band where the decoded signal shows good speech quality; a spectrum correcting section that corrects a spectrum of the decoded signal in the determined band such that changes of the spectrum in the frequency domain are reduced; and a filter section that filters the decoded signal using a coefficient derived from the corrected spectrum.

The post filtering method according to the present invention of reducing quantization noise in a decoded signal of a signal subjected to layered coding according to a coding scheme providing a plurality of layers, includes: determining a band where the decoded signal shows good speech quality; correcting a spectrum of the decoded signal in the determined band such that changes of the spectrum in the frequency domain are reduced; and filtering the decoded signal using a coefficient derived from the corrected spectrum.

Advantageous Effect of the Invention

The present invention enables speech quality improvement of decoded signals when speech quality of the decoded signals vary between bands.

BEST MODE FOR CARRYING OUT THE INVENTION

Figure 1:
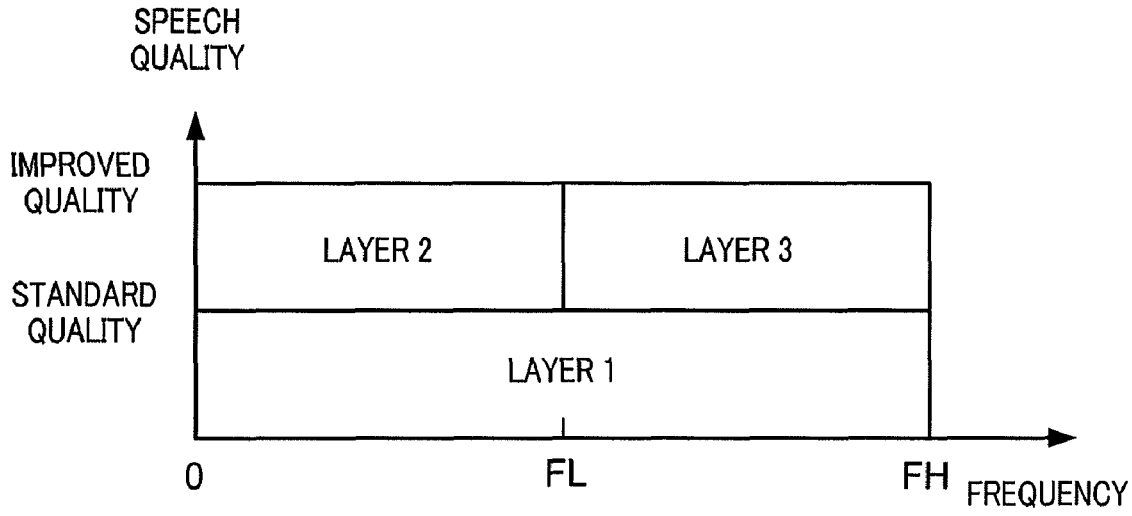
FIG.1 PRIOR ART
FIG. 1 shows a layer configuration in scalable coding.
Figure 2:
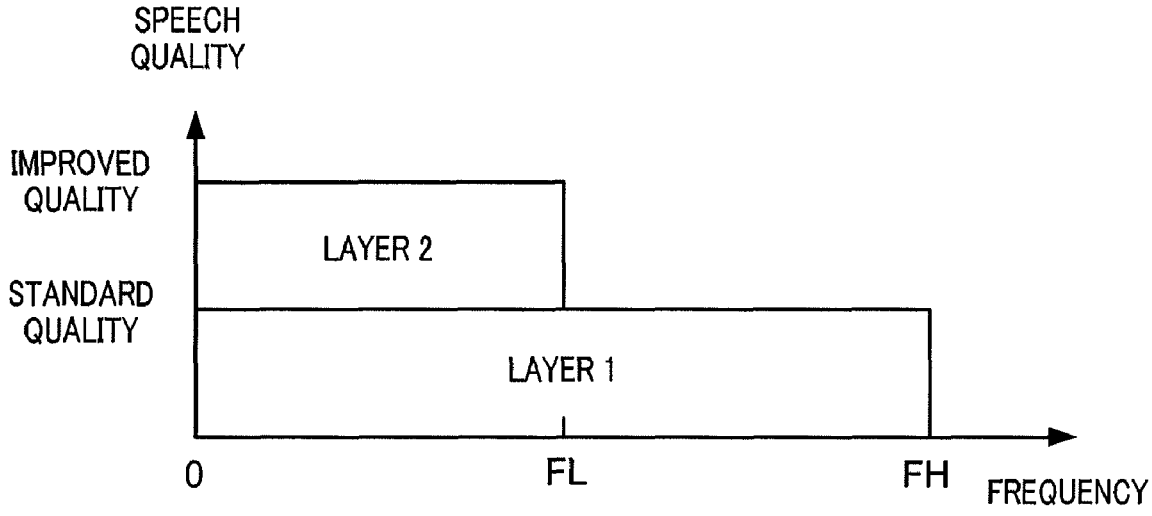
FIG.2 PRIOR ART
FIG. 2 shows a layer configuration in scalable coding.

Embodiments of the present invention will be described in detail with reference to the accompanying drawings. However, in the embodiments, configurations having the same functions are assigned the same reference numerals and overlapping description will be omitted. Further, examples of three-layer coding (scalable coding and embedded coding)

will be described with embodiments of the present invention where layer 1 to layer 3 support signal bands and speech quality as shown in FIG. 1.

Embodiment 1

Figure 3:
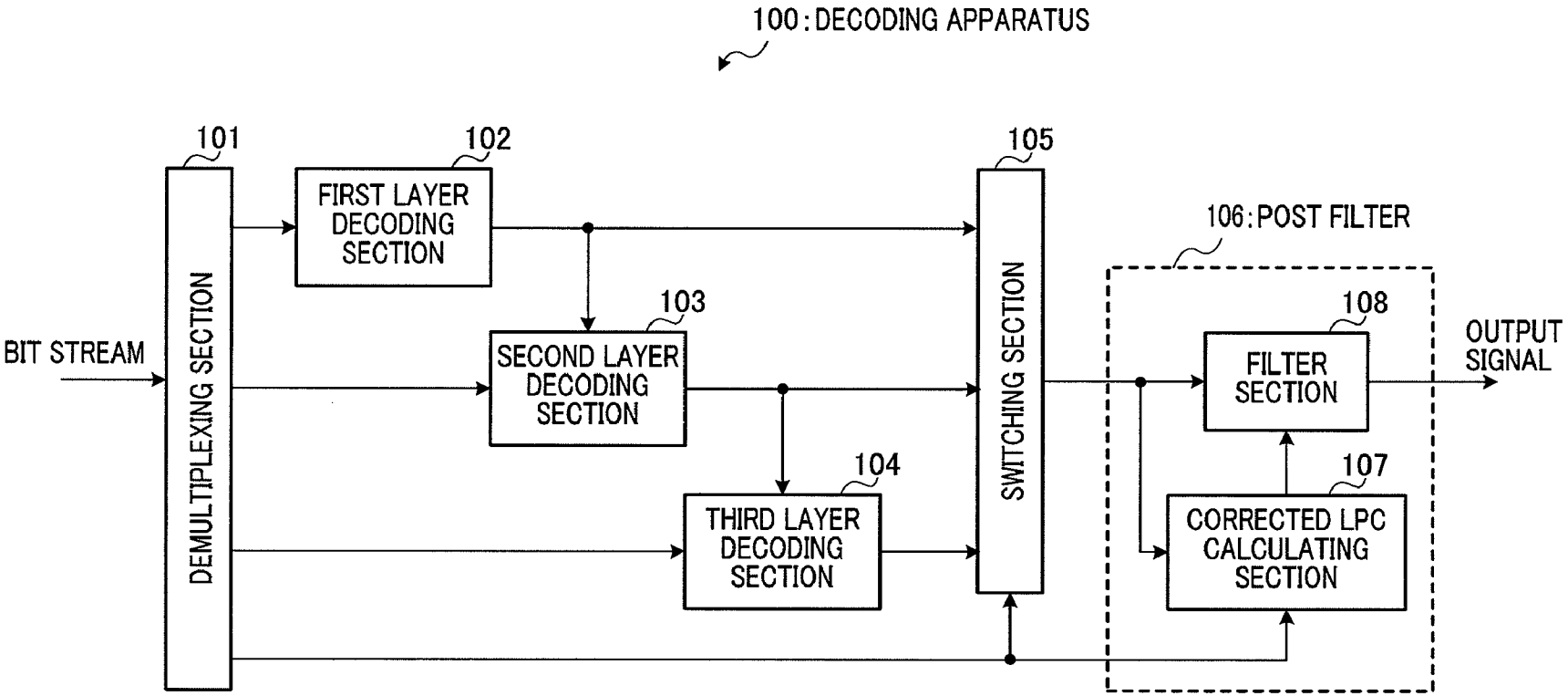
FIG. 3 is a block diagram showing a main configuration of the decoding apparatus according to Embodiment 1 of the present invention.

FIG. 3 is a block diagram showing a main configuration of decoding apparatus 100 according to Embodiment 1 of the present invention. In this figure, demultiplexing section 101 receives a bit stream sent out from a coding apparatus (not shown), separates the bit stream based on layer information recorded in the received bit stream and outputs the layer information to switching section 105 and corrected LPC calculating section 107 of post filter 106.

When the layer information shows layer 3, that is, when encoded codes of all layers (the first layer to the third layer) are included in the bit stream, demultiplexing section 101 separates the first layer encoded code, the second layer encoded code and the third layer encoded code from the bit stream. The separated first layer encoded code is outputted to first layer decoding section 102, the second layer encoded code is outputted to second layer decoding section 103 and the third layer encoded code is outputted to third layer decoding section 104.

Further, when the layer information shows layer 2, that is, when encoded codes of the first layer and the second layer are included in the bit stream, demultiplexing section 101 separates the first layer encoded code and the second layer encoded code from the bit stream. The separated first layer encoded code is outputted to first layer decoding section 102 and the second layer encoded code is outputted to second layer decoding section 103.

Moreover, when the layer information shows layer 1, that is, when only the encoded code of the first layer is included in the bit stream, demultiplexing section 101 separates the first layer encoded code from the bit stream and outputs the separated first layer encoded code to first layer decoding section 102.

First layer decoding section 102 generates a first layer decoded signal of standard quality where signal band k is equal to or more than 0 and less than FH, using the first layer encoded code outputted from demultiplexing section 101, and outputs the generated first layer decoded signal to switching section 105 and second layer decoding section 103.

When demultiplexing section 101 outputs the second layer encoded code, second layer decoding section 103 generates a second layer decoded signal of improved quality where signal band k is equal to or more than 0 and less than FL and a second layer decoded signal of standard quality where signal band k is equal to or more than FL and less than FH, using this second layer encoded code and the first layer decoded signal outputted from first layer decoding section 102. Second layer decoding section 103 outputs the generated second layer decoded signals to switching section 105 and third layer decoding section 104. Further, when the layer information shows layer 1, the second layer encoded code cannot be obtained and second layer decoding section 103 does not operate at all or updates variables provided in second layer decoding section 103.

When demultiplexing section 101 outputs the third layer encoded code, third layer decoding section 104 generates a third layer decoded signal of improved quality where signal band k is equal to or more than 0 and less than FH, using the third layer encoded code and the second layer decoded signals outputted from second layer decoding section 103. Third layer decoding section 104 outputs the generated third layer decoded signal to switching section 105. Further, when the layer information shows layer 1 or layer 2, third layer decoding section 104 does not operate at all or updates variables provided in third layer decoding section 104.

Switching section 105 decides by which layer decoded signals can be obtained based on the layer information outputted from demultiplexing section 101 and outputs the decoded signal of the layer of the highest order to corrected LPC calculating section 107 and filter section 108.

Post filter 106 has corrected LPC calculating section 107 and filter section 108. Corrected LPC calculating section 107 calculates corrected LPC coefficients using the layer information outputted from demultiplexing section 101 and the decoded signals outputted from switching section 105, and outputs the calculated corrected LPC coefficients to filter section 108. Corrected LPC calculating section 107 will be described in detail later.

Filter section 108 forms a filter using the corrected LPC coefficients outputted from corrected LPC calculating section 107, carries out post filtering of the decoded signal outputted from switching section 105 and outputs the decoded signal subjected to post filtering.

Figure 4:
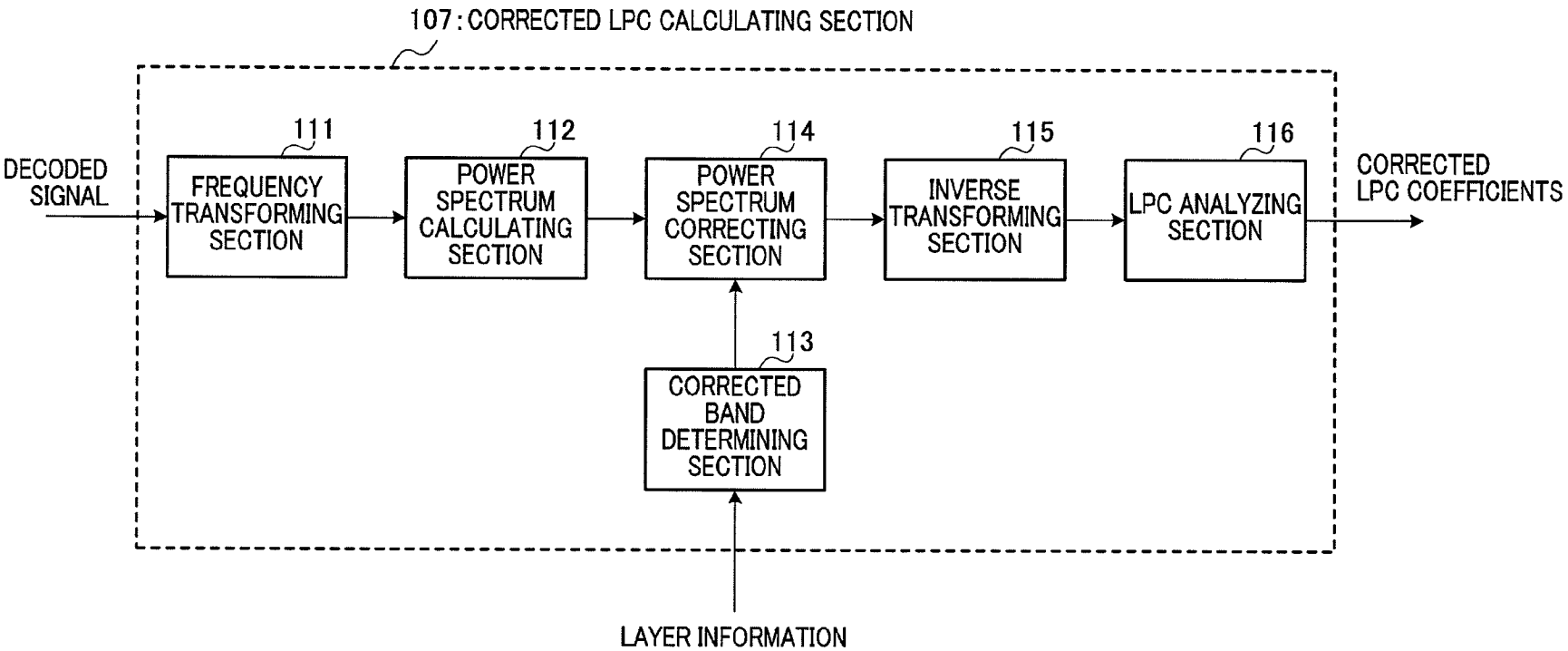
FIG. 4 is a block diagram showing an internal configuration of a corrected LPC calculating section shown in FIG. 3.

FIG. 4 is a block diagram showing an internal configuration of corrected LPC calculating section 107 shown in FIG. 3. In this figure, frequency transforming section 111 analyzes the frequency of the decoded signal outputted from switching section 105, finds the spectrum of the decoded signal (hereinafter "decoded spectrum") and outputs the decoded spectrum to power spectrum calculating section 112.

Power spectrum calculating section 112 calculates power of the decoded spectrum (hereinafter "power spectrum") outputted from frequency transforming section 111 and outputs the calculated power spectrum to power spectrum correcting section 114.

Corrected band determining section 113 determines the band in which the power spectrum is corrected based on the layer information outputted from demultiplexing section 101 (hereinafter "corrected band") and outputs the determined band to power spectrum correcting section 114 as corrected band information.

In this embodiment, the layers shown in FIG. 1 support signal bands and speech quality, and corrected band determining section 113 generates the corrected band information based on the corrected band equaling 0 (not corrected) when the layer information shows layer 1, the corrected band between 0 and FL when the layer information shows layer 2 and the corrected band between 0 and FH when the layer information shows layer 3.

Power spectrum correcting section 114 corrects the power spectrum outputted from power spectrum calculating section 112 based on the corrected band information outputted from corrected band determining section 113 and outputs the corrected power spectrum to inverse transforming section 115.

Here, "power spectrum correction" refers to setting the characteristics of post filter 106 weak, such that the spectrum is corrected less. To be more specific, power spectrum correction refers to carrying out modification such that changes of the power spectrum in the frequency domain are reduced. As a result of this, when the layer information shows layer 2, the characteristics of post filter 106 in the band between 0 and FL are set weak, and when the layer information shows layer 3, the characteristics of post filter 106 in the band between 0 and FH are set weak.

Inverse transforming section 115 inverse transforms the corrected power spectrum outputted from power spectrum correcting section 114 and finds an auto correlation function. The auto correlation function is outputted to LPC analyzing section 116. Further, inverse transforming section 115 is able to reduce the amount of calculation by utilizing FFT (Fast Fourier Transform). At this time, when the order of the corrected power spectrum cannot be represented by $2^N$, the corrected power spectrum may be averaged such that the analysis length is $2^N$, or the corrected power spectrum may be decimated.

LPC analyzing section 116 finds LPC coefficients by applying an auto correlation method to the auto correlation function outputted from inverse transforming section 115 and outputs the LPC coefficients to filter section 108 as corrected LPC coefficients.

Next, methods of implementing above power spectrum correcting section 114 will be described in detail. First, a method of smoothing the power spectrum of the corrected band will be described as the first implementation method. This method calculates an average value of the power spectrum of the corrected band and replaces the power spectrum before smoothing with the calculated average value.

Figure 5:
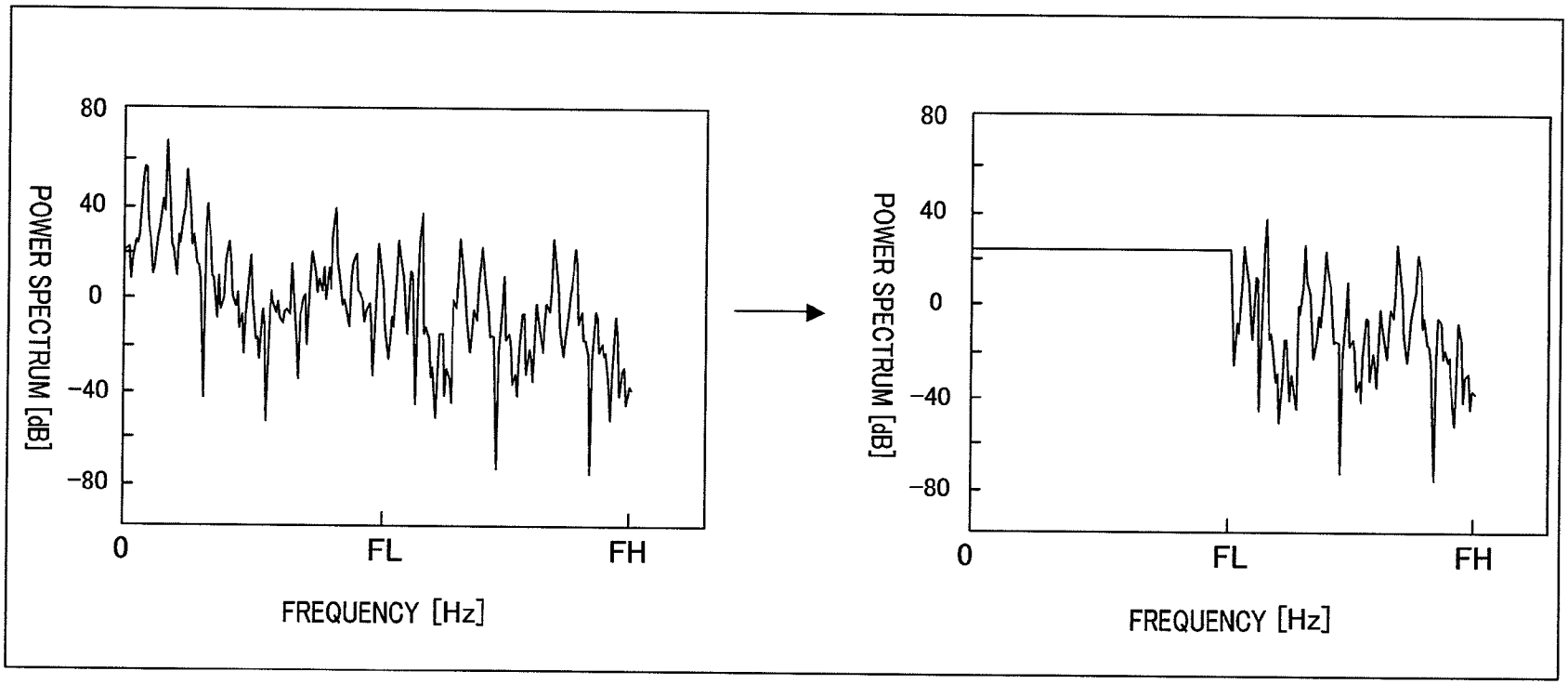
FIG. 5 shows a power spectrum corrected by the first implementation method of the power spectrum correcting section shown in FIG. 4.

FIG. 5 shows the power spectrum corrected by the first implementation method. This figure shows that the power spectrum of the voiced part (/o/) of the female is corrected when the layer information shows layer 2 (the characteristics of post filter 106 in the band between 0 and FL is set weak) and shows replacement of the band between 0 and FL with a power spectrum of approximately 22 dB. At this time, it is preferable to correct the power spectrum such that the spectrum does not change discontinuously at a boundary between the band to be corrected and the band not to be corrected. The details of this method include, for example, finding an average value of changes of the power spectra of the boundary and its neighborhood and replacing the target power spectrum with the average value of changes. As a result, it is possible to find the corrected LPC coefficients reflecting the more accurate spectral characteristics.

Next, a second method of implementing power spectrum correcting section 114 will be described. The second implementation method includes finding a spectral tilt of the power spectrum of the corrected band and replacing the spectrum of the band with the spectral tilt. Here, the "spectral tilt" refers to an overall tilt of the power spectrum of the band. For example, the spectral characteristics of a digital filter formed by a PARCOR coefficient (reflection coefficient) of the first order of a decoded signal or by multiplying the PARCOR coefficient by a constant. The power spectrum of the band is replaced with this spectral characteristics multiplied by a coefficient calculated such that energy of the power spectrum of the band is stored.

Figure 6:
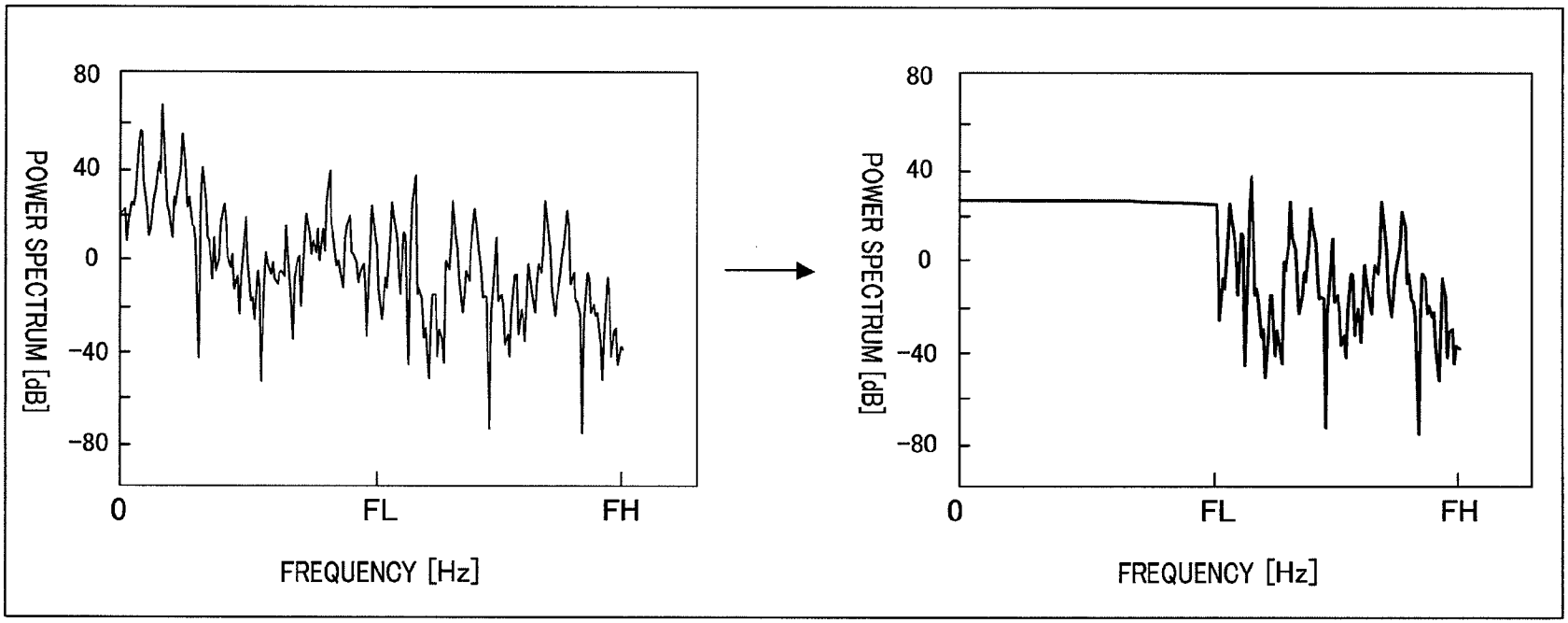
FIG. 6 shows a power spectrum corrected by the second implementation method of the power spectrum correcting section shown in FIG. 4.

FIG. 6 shows the power spectrum correction according to the second implementation method. In this figure, the power spectrum of the band between 0 and FL is replaced with a power spectrum tilted between approximately 23 dB to 26 dB.

By replacing the power spectrum of the corrected band with a spectral tilt in this way, the effects of emphasizing the higher band by a tilt compensation filter (U(z) of equation 1) of post filter 106 cancel each other within the band. That is, the spectral characteristics equaling the inverse characteristics of the spectral characteristics U(z) of equation 1 is given. As a result of this, the spectral characteristics of the band including post filter 106 can further be smoothed.

Further, a third method of implementing power spectrum correcting section 114 includes using $\alpha$-th ($0<\alpha<1$) power of the power spectrum of the corrected band. This method enables more flexible design of characteristics of post filter 106 compared to the above method of smoothing the power spectrum.

Next, the spectral characteristics of post filter 106 formed with the above corrected LPC coefficients calculated by corrected LPC calculating section 107 will be described with reference to FIG. 7. Here, a case will be described with the spectral characteristics as an example where the corrected LPC coefficients are found using the spectrum shown in FIG. 6 and the set values of post filter 106 are $\gamma_n$=0.6, $\gamma_d$=0.8 and $\mu$=0.4. Further, the LPC coefficients have the eighteenth order.

Figure 7:
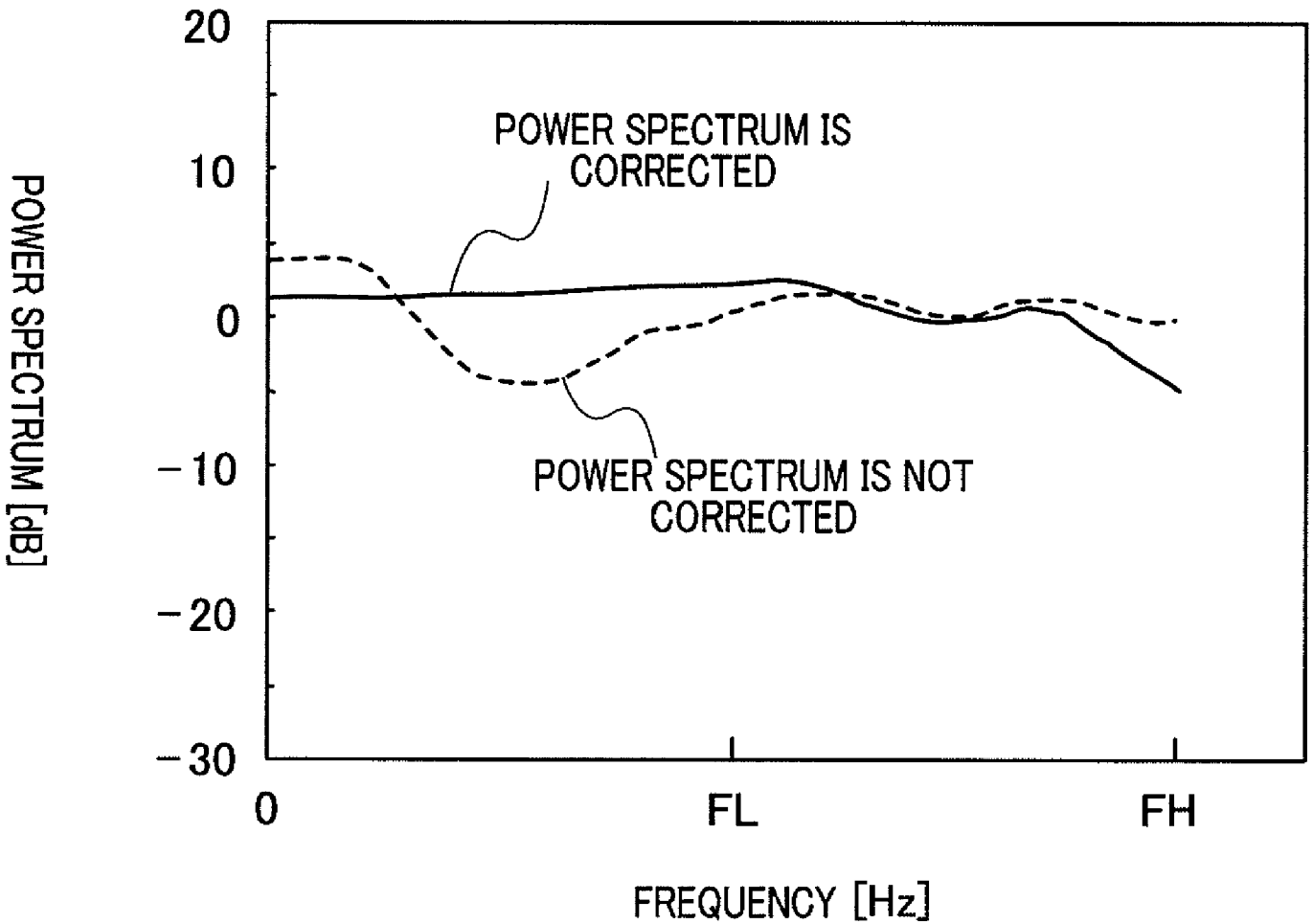
FIG. 7 illustrates the spectral characteristics of the post filter shown in FIG. 3.

The solid line shown in FIG. 7 shows the spectral characteristics when the power spectrum is corrected and the dotted line shows the spectral characteristics when the power spectrum is not corrected (the set values are the same as above). As shown in FIG. 7, when the power spectrum is corrected, the characteristics of post filter 106 become almost smoothed in the band between 0 and FL and become the same spectral characteristics in the band between FL to FH as in the case where the power spectrum is not corrected.

On the other hand, although in the neighborhood of the Nyquist frequency, when the power spectrum is corrected, the spectral characteristics become attenuated a little compared to the spectral characteristics in the case where the power spectrum is not corrected, the signal component of this band is smaller than signal components of other bands, and so this influence can be almost ignored.

In this way, according to Embodiment 1, the power spectrum of a band according to layer information is corrected, corrected LPC coefficients are calculated based on the corrected power spectrum and a post filter is formed using the calculated corrected LPC coefficients, so that, even when speech quality vary between bands processed by layers, it is possible to carry out post filtering of a decoded signal based on the spectral characteristics according to speech quality and, consequently, improve speech quality.

Further, a case has been described with this embodiment where, when layer information shows any one of layer 1 to layer 3, corrected LPC coefficients are calculated. When a layer processes all bands, which subjected to encoding, for approximately same speech quality (in this embodiment, layer 1 for processing full bands for standard quality and layer 3 for processing full bands for improved quality), the corrected LPC coefficients need not to be calculated per band. In this case, set values ($\gamma_d$, $\gamma_n$ and $\mu$) specifying the degree of post filter 106 may be prepared per layer in advance and post filter 106 may be directly formed by switching the prepared set values. As a result of this, it is possible to reduce the amount and time of processing required to calculate corrected LPC coefficients.

Embodiment 2

Figure 8:
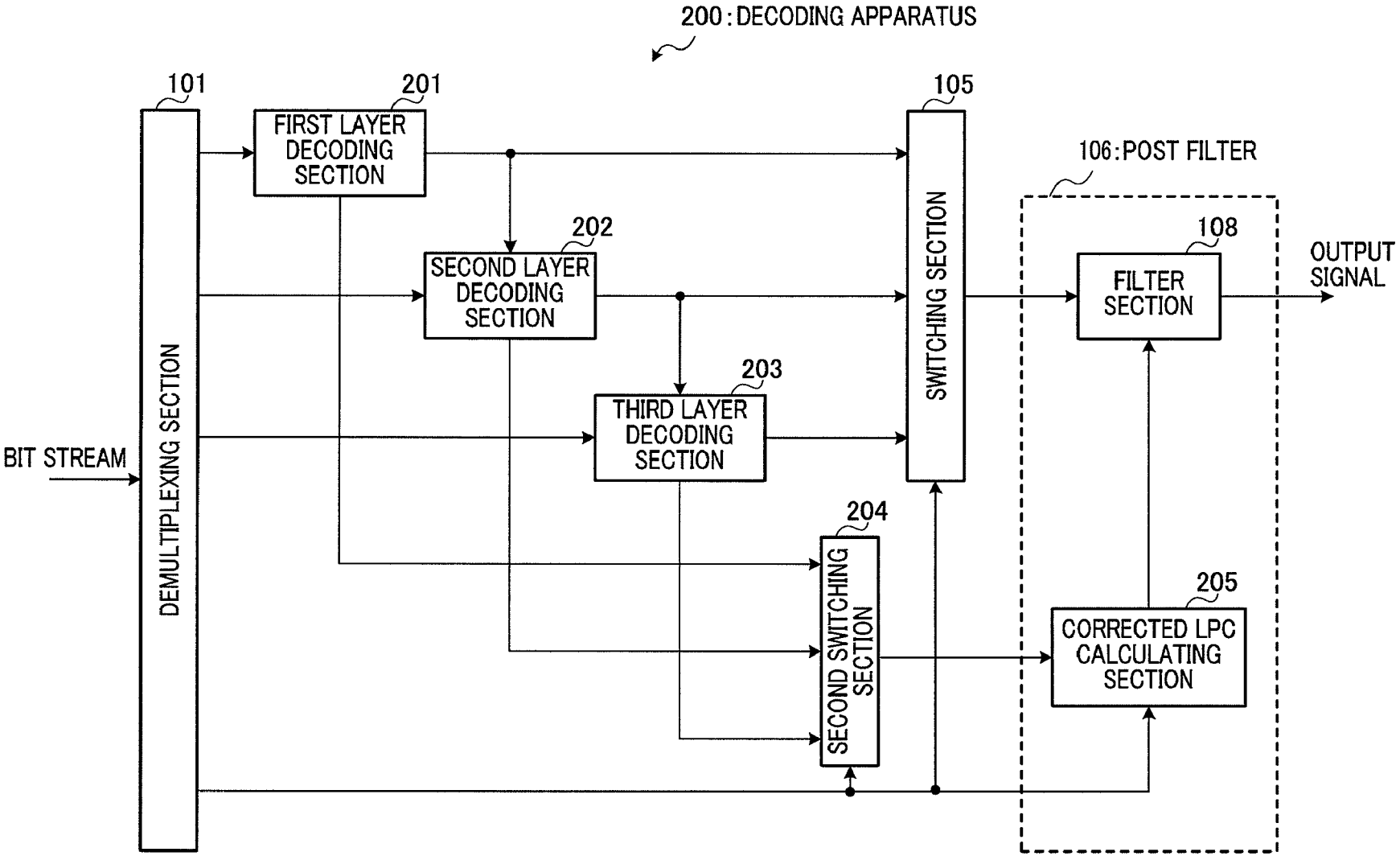
FIG. 8 is a block diagram showing a main configuration of the decoding apparatus according to Embodiment 2 of the present invention.

FIG. 8 is a block diagram showing a main configuration of decoding apparatus 200 according to Embodiment 2 of the present invention. In this figure, first layer decoding section 201 generates a first layer decoded signal of standard quality where signal band k is equal to or more than 0 and less than FH, using a first layer encoded code outputted from demultiplexing section 101, and outputs the generated first layer decoded signal to switching section 105 and second layer decoding section 202. Further, first layer decoding section 201 generates first layer decoding LPC coefficients in the process of generating the first layer decoded signal and outputs the generated first layer decoding LPC coefficients to second switching section 204.

When demultiplexing section 101 outputs a second layer encoded code, second layer decoding section 202 generates a second layer decoded signal of improved quality where signal band k is equal to or more than 0 and less than FL and a second layer decoded signal of standard quality where signal band k is equal to or more than FL and less than FH, using the second layer encoded code and the first layer decoded signals outputted from first layer decoding section 201. Further, second layer decoding section 202 generates second layer decoding LPC coefficients in the process of generating the second layer decoded signals. The generated second layer decoded signals are outputted to switching section 105 and third layer decoding section 203, and the second layer decoding LPC coefficients are outputted to second switching section 204.

When demultiplexing section 101 outputs a third layer encoded code, third layer decoding section 203 generates a third layer decoded signal of improved quality where signal k is equal to or more than 0 and less than FH, using this third layer encoded code and the second layer decoded signals outputted from second layer decoding section 202. Further, third layer decoding section 203 generates third layer decoding LPC coefficients in the process of generating the third layer decoded signal. The generated third layer decoded signal is outputted to switching section 105 and the third layer decoding LPC coefficients are outputted to second switching section 204.

Second switching section 204 obtains layer information from demultiplexing section 101, decides by which layer decoded signals can be obtained based on the obtained layer information and outputs the decoded LPC coefficients of the layer of the highest order to corrected LPC calculating section 205. However, there may be a case where the decoded LPC coefficients are not generated in the process of decoding processing, and, in this case, one of decoded LPC coefficients is selected from the decoded LPC coefficients obtained by second switching section 204.

Corrected LPC calculating section 205 calculates corrected LPC coefficients using the layer information outputted from demultiplexing section 101 and the decoded LPC coefficients outputted from second switching section 204, and outputs the calculated corrected LPC coefficients to filter section 108.

Figure 9:
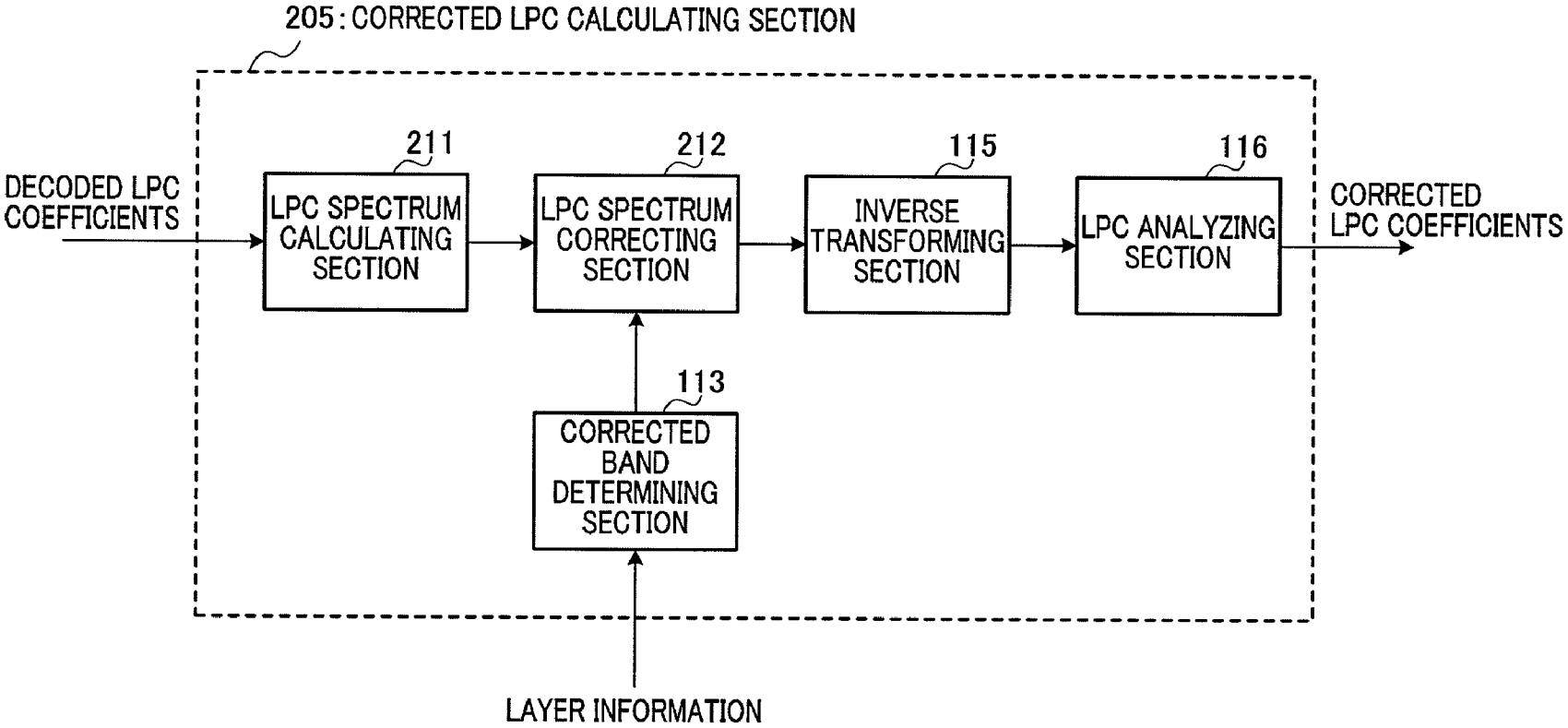
FIG. 9 is a block diagram showing an internal configuration of the corrected LPC calculating section shown in FIG. 8.

FIG. 9 is a block diagram showing an internal configuration of corrected LPC calculating section 205 shown in FIG. 8. In this figure, LPC spectrum calculating section 211 subjects the decoded LPC coefficients outputted from second switching section 204 to discrete Fourier transform, calculates the energy of each complex spectrum and outputs the calculated energy to LPC spectrum correcting section 212 as an LPC spectrum.

LPC spectrum correcting section 212 calculates a corrected LPC spectrum from the LPC spectrum outputted from LPC spectrum calculating section 211, based on corrected band information outputted from corrected band determining section 113, and outputs the calculated corrected LPC spectrum to inverse transforming section 115.

In this way, according to Embodiment 2, an LPC spectrum calculated from decoded LPC coefficients shows only a spectral envelope from which details of the decoded signal are removed, and a more accurate post filter can be realized by finding corrected LPC coefficients based on this spectral envelope, so that it is possible to improve speech quality.

Embodiment 3

Figure 10:
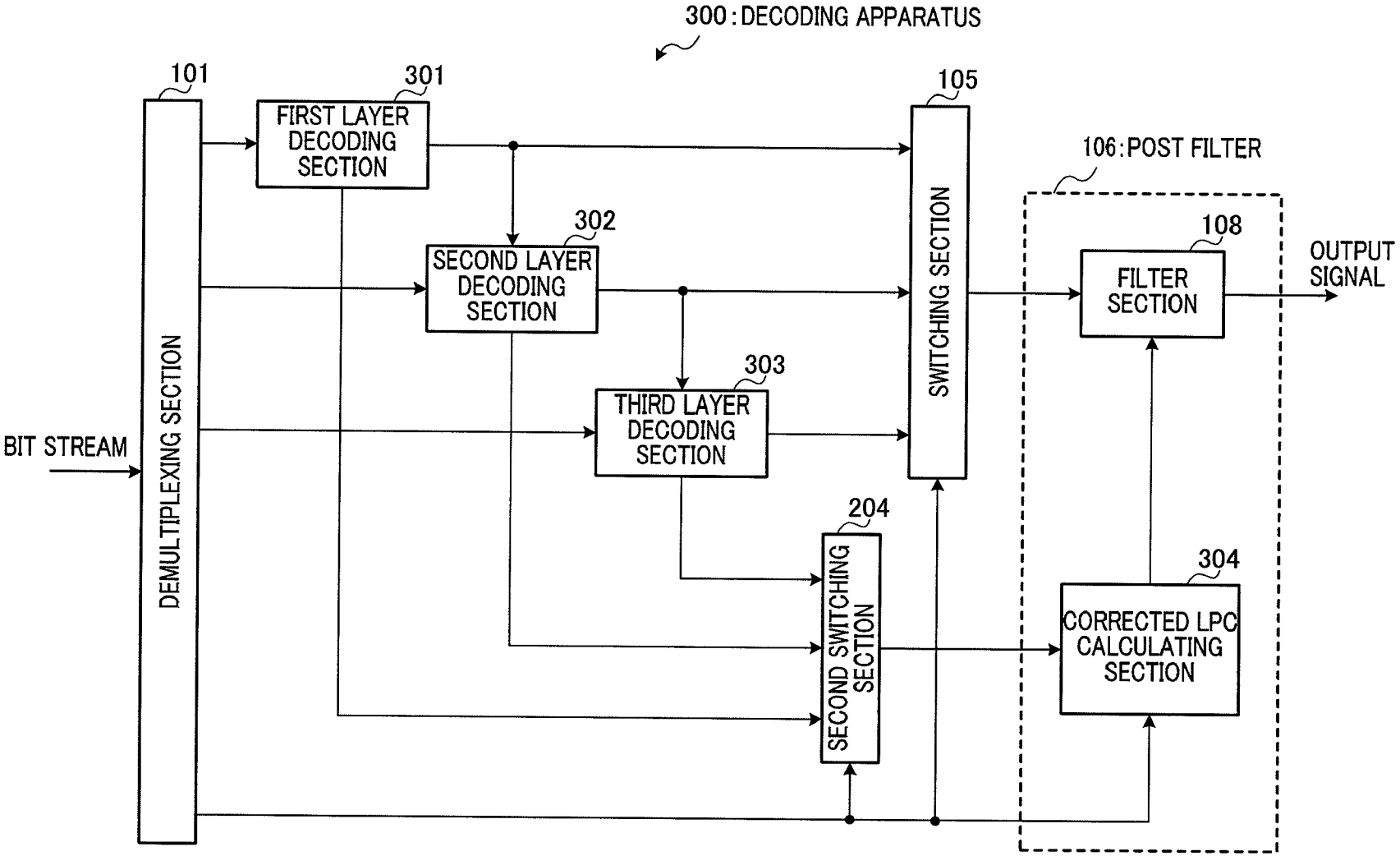
FIG. 10 is a block diagram showing a main configuration of the decoding apparatus according to Embodiment 3 of the present invention.

FIG. 10 is a block diagram showing a main configuration of decoding apparatus 300 according to Embodiment 3 of the present invention. In this figure, first layer decoding section 301 generates a first layer decoded signal of standard quality where signal band k is equal to or more than 0 and less than FH, using a first layer encoded code outputted from demultiplexing section 101, and outputs the generated first layer decoded signal to switching section 105 and second layer decoding section 302. Further, first layer decoding section 301 generates a first layer decoded spectrum in the process of generating the first layer decoded signal and outputs the generated first layer decoded spectrum to second switching section 204.

When demultiplexing section 101 outputs a second layer encoded code, second layer decoding section 302 generates a second layer decoded signal of improved quality where signal band k is equal to or more than 0 and less than FL and a second layer decoded signal of standard quality where signal band k is equal to or more than FL and less than FH, using the second layer encoded code and the first layer decoded signal outputted from first layer decoding section 301. Further, second layer decoding section 302 generates a second layer decoded spectrum in the process of generating the second layer decoded signals. The generated second layer decoded signals are outputted to switching section 105 and third layer decoding section 303 and the second layer decoded spectrum is outputted to second switching section 204.

When demultiplexing section 101 outputs a third layer encoded code, third layer decoding section 303 generates a third layer decoded signal of improved quality where signal band k is equal to or more than 0 and less than FH, using this third layer encoded code and the second layer decoded signals outputted from second layer decoding section 302. Further, third layer decoding section 303 generates a third layer decoded spectrum in the process of generating the third layer decoded signal. The generated third layer decoded signal is outputted to switching section 105 and the third layer decoded spectrum is outputted to second switching section 204.

Corrected LPC calculating section 304 calculates corrected LPC coefficients using the layer information outputted from demultiplexing section 101 and the decoded spectrum outputted from second switching section 204 and outputs the calculated corrected LPC coefficients to filter section 108.

Figure 11:
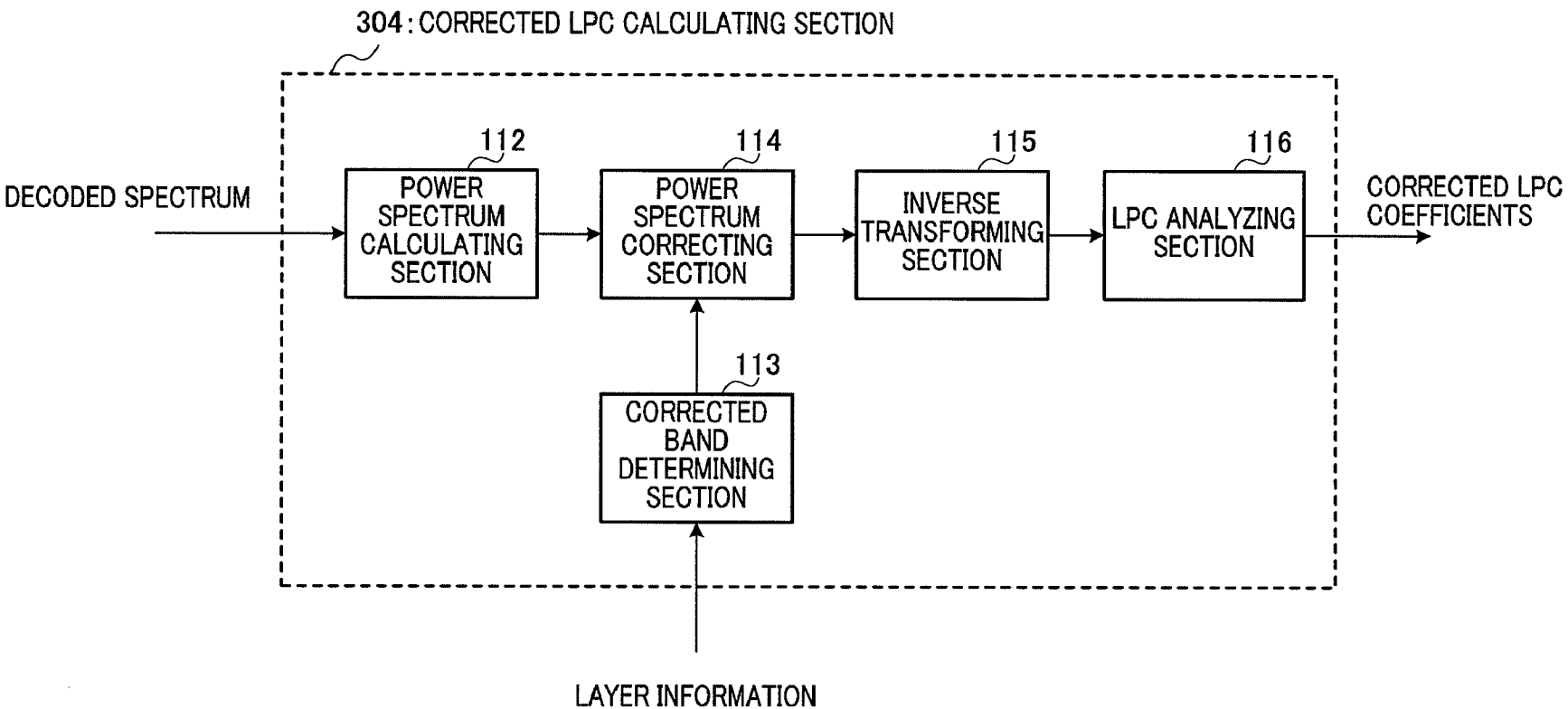
FIG. 11 is a block diagram showing an internal configuration of the corrected LPC calculating section shown in FIG. 10.

Corrected LPC calculating section 304 has the internal configuration shown in FIG. 11 and calculates corrected LPC coefficients without carrying out frequency transformation.

In this way, according to Embodiment 3, a power spectrum is calculated from a decoded spectrum generated in the decoding process and corrected LPC coefficients are calculated using the calculated power spectrum, so that it is possible to reduce frequency transforming processing for transforming a time domain signal into a frequency domain signal.

Embodiment 4

Figure 12:
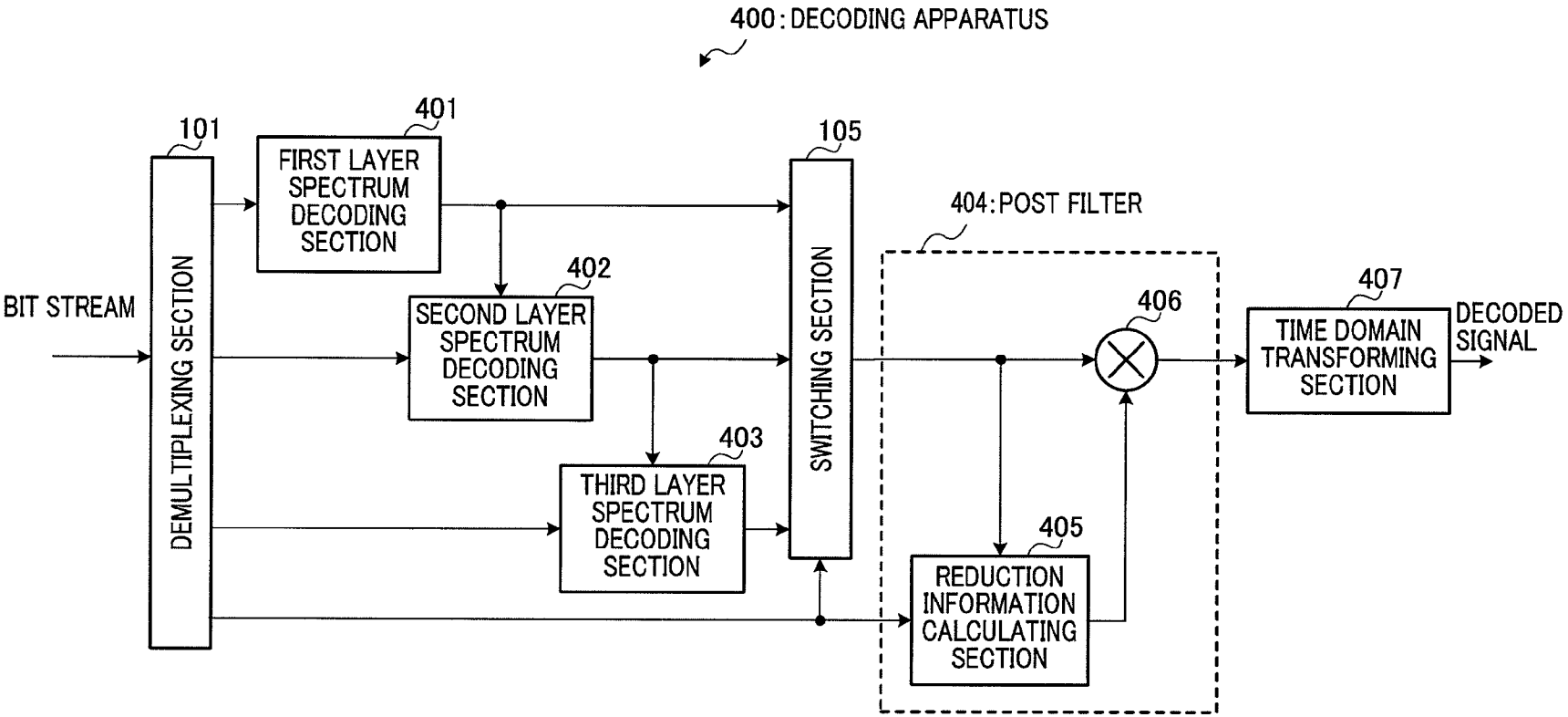
FIG. 12 is a block diagram showing a main configuration of the decoding apparatus according to Embodiment 4 of the present invention.

FIG. 12 is a block diagram showing a main configuration of decoding apparatus 400 according to Embodiment 4 of the present invention. In this figure, first layer spectrum decoding section 401 generates a first layer decoded spectrum of standard quality where signal band k is equal to or more than 0 and less than FH, using a first layer encoded code outputted from demultiplexing section 101 and outputs the generated first layer decoded spectrum to switching section 105 and second layer spectrum decoding section 402.

When demultiplexing section 101 outputs a second layer encoded code, second layer spectrum decoding section 402 generates a second layer decoded spectrum of improved quality where signal band k is equal to or more than 0 and less than FL and a second layer decoded spectrum of standard quality where signal band k is equal to or more than FL and less than FH, using this second layer encoded code and the first layer decoded spectrum outputted from first layer spectrum decoding section 401. Second layer spectrum decoding section 402 outputs the generated second layer decoded spectra to switching section 105 and third layer spectrum decoding section 403.

When demultiplexing section 101 outputs a third layer encoded code, third layer spectrum decoding section 403 generates a third layer decoded spectrum of improved quality where signal band k is equal to or more than 0 and less than FH, using this third layer encoded code and the second layer decoded spectra outputted from second layer spectrum decoding section 402. Third layer spectrum decoding section 403 outputs the generated third layer decoded signal to switching section 105.

Post filter 404 has reduction information calculating section 405 and multiplier 406. Reduction information calculating section 405 calculates reduction information for reducing the decoded spectrum outputted from switching section 105 per subband, based on the layer information outputted from demultiplexing section 101, and outputs the calculated reduction information to multiplier 406. Reduction information calculating section 405 will be described in detail later.

Multiplier 406, which is a filter means, multiplies the decoded spectrum outputted from switching section 105 by the reduction information outputted from reduction information calculating section 405, and outputs the decoded spectrum multiplied by the reduction information to time domain transforming section 407.

Time domain transforming section 407 transforms the decoded spectrum outputted from multiplier 406 of post filter 404 into a time domain signal and outputs the result as a decoded signal.

Figure 13:
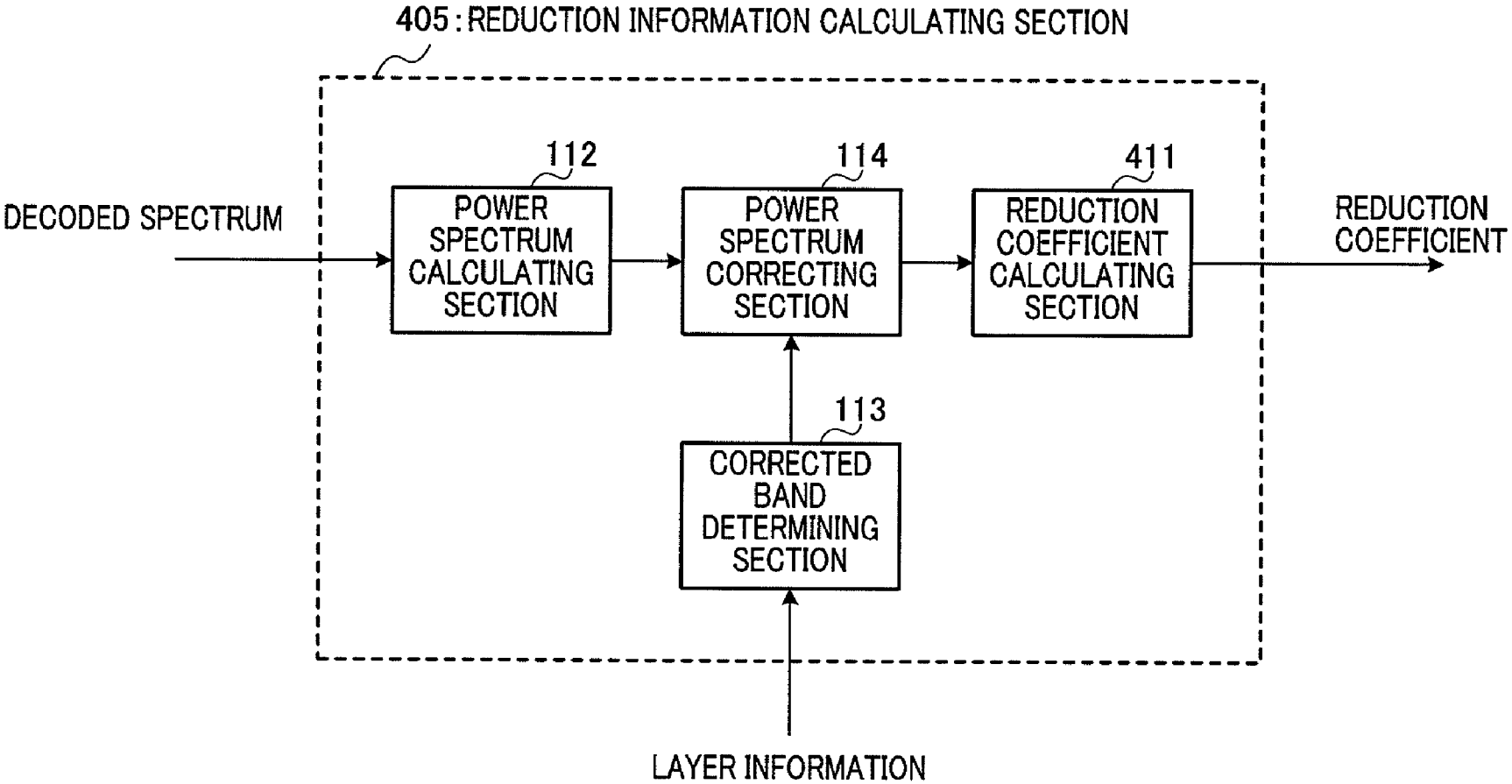
FIG. 13 is a block diagram showing an internal configuration of a reduction information calculating section shown in FIG. 12.

FIG. 13 is a block diagram showing an internal configuration of reduction information calculating section 405 shown in FIG. 12. In this figure, reduction coefficient calculating section 411 divides the corrected power spectrum outputted from power spectrum correcting section 114 into subbands of a predetermined bandwidth, and finds an average value per divided subband. Then, reduction coefficient calculating section 411 selects a subband having found average value smaller than a threshold value and calculates a coefficient (vector value) of the selected subband for reducing a decoded spectrum. As a result of this, it is possible to attenuate the subband including the band of a spectral valley. Moreover, the reduction coefficient is calculated based on the average value of the selected subband. To be more specific, the calculation method refers to, for example, calculating the reduction coefficient by multiplying the average of the subband by a predetermined coefficient. Further, with respect to subbands having average values equal to or more than a predetermined threshold value, a coefficient which does not change a decoded spectrum is calculated.

Further, the reduction coefficient may not be LPC coefficients and may be a coefficient by which the decoded spectrum can be directly multiplexed. As a result of this, it is not necessary to carry out inverse transforming processing and LPC analysis processing, so that it is possible to reduce the amount of calculation required for these processings.

In this way, according to Embodiment 4, by finding a reduction coefficient from a decoded spectrum and directly multiplying the decoded spectrum by the reduction coefficient, the spectrum of a decoded signal is modified in the frequency domain, and inverse transforming processing and LPC analysis processing need not to be carried out, so that it is possible to reduce the amount of calculation required for these processings.

Embodiment 5

Figure 14:
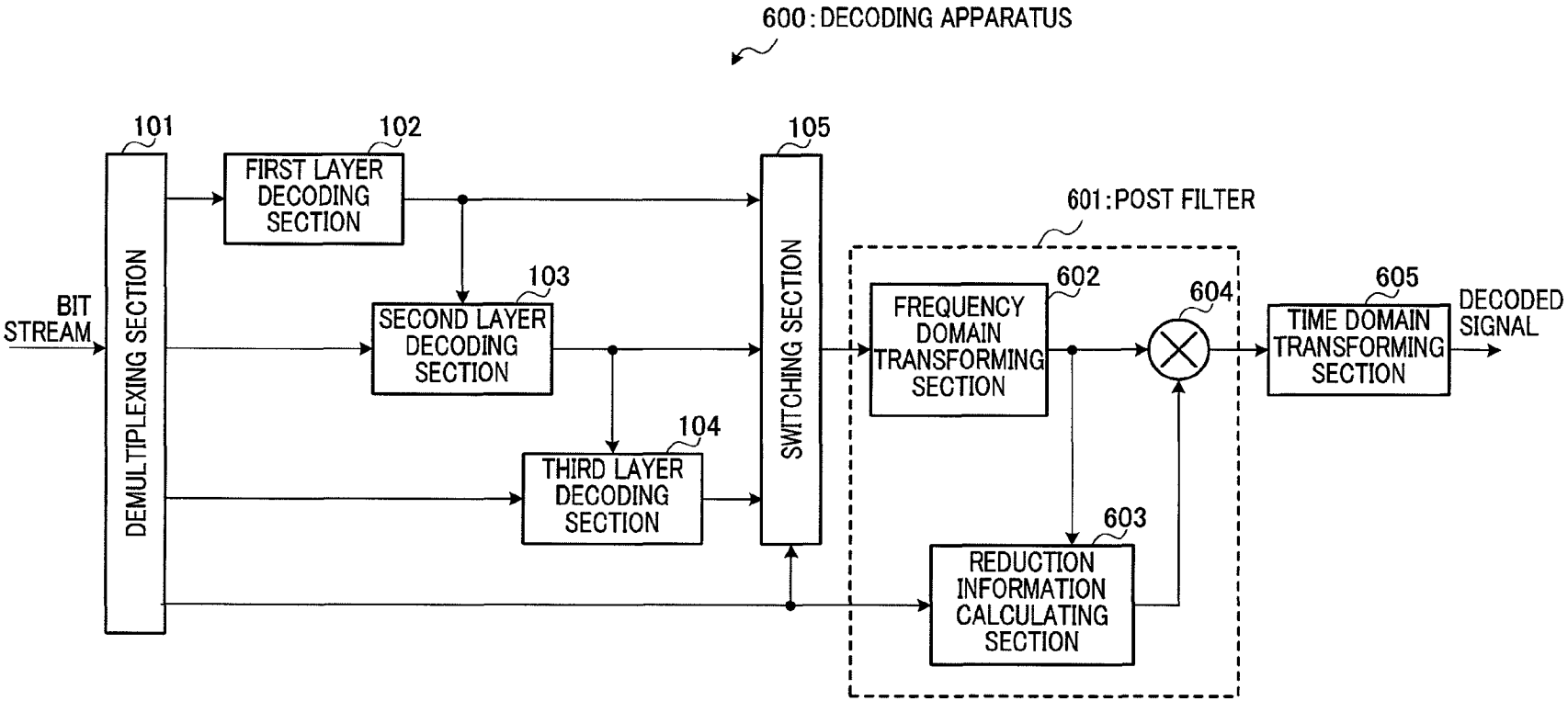
FIG. 14 is a block diagram showing a main configuration of the decoding apparatus according to Embodiment 5 of the present invention.

FIG. 14 is a block diagram showing a main configuration of decoding apparatus 600 according to Embodiment 5 of the present invention. In this figure, post filter 601 has frequency domain transforming section 602, reduction information calculating section 603 and multiplier 604. Frequency domain transforming section 602 generates a decoded spectrum by transforming an n-th decoded signal (where n is 1 to 3) outputted from switching section 105 into the frequency domain and outputs the generated decoded spectrum to reduction information calculating section 603 and multiplier 604.

Reduction information calculating section 603 calculates reduction information for reducing the decoded signal outputted from switching section 105 per subband and outputs the calculated reduction information to multiplier 604. The detailed description of reduction information calculating section 603 is the same as in the configuration shown in FIG. 13 and will be omitted.

Multiplier 604, which is a filter means, multiplies the decoded spectrum outputted from frequency domain transforming section 602 by the reduction information outputted from reduction information calculating section 603, and outputs the decoded spectrum multiplied by the reduction information to time domain transforming section 605.

Time domain transforming section 605 transforms the decoded spectrum outputted from multiplier 604 of post filter 601 into a time domain signal and outputs the decoded signal.

In this way, according to Embodiment 5, by finding a reduction coefficient from a decoded signal and directly multiplying the decoded signal by the reduction coefficient, the spectrum of the decoded signal is modified in the frequency domain, and inverse transforming processing and LPC analysis processing need not to be carried out, so that it is possible to reduce the amount of calculation required for these processings.

Embodiment 6

Figure 15:
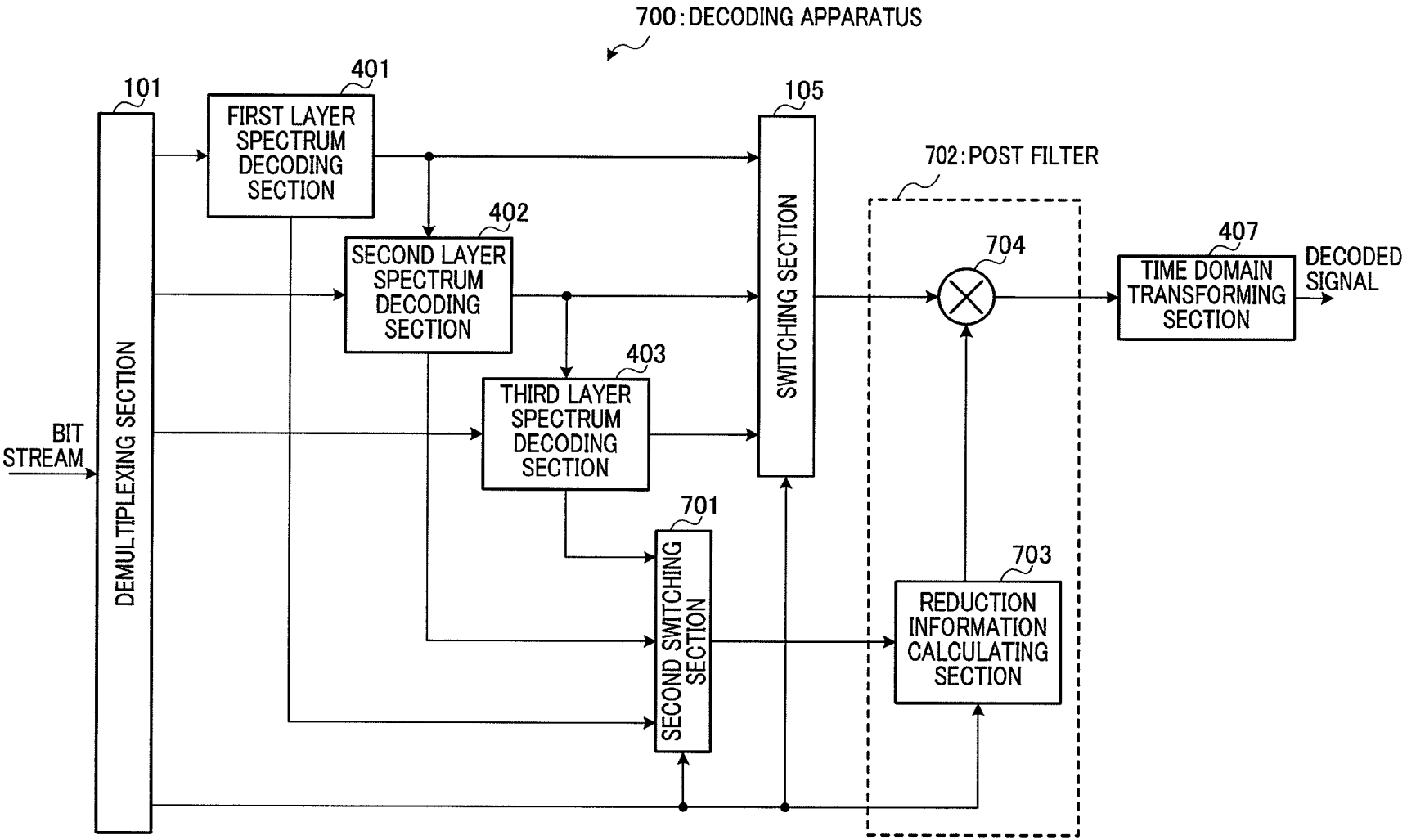
FIG. 15 is a block diagram showing a main configuration of the decoding apparatus according to Embodiment 6 of the present invention.

FIG. 15 is a block diagram showing a main configuration of decoding apparatus 700 according to Embodiment 6 of the present invention. In this figure, second switching section 701 obtains layer information from demultiplexing section 101, decides by which layer decoded spectra can be obtained, based on the obtained layer information and outputs the decoded LPC coefficients of the layer of the highest order to post filter 702 and reduction information calculating section 703. However, the decoded LPC coefficients are not likely to be generated in the process of decoding processing. In this case, one decoded LPC coefficient is selected from the decoded LPC coefficients obtained by second switching section 701.

Reduction information calculating section 703 calculates reduction information using layer information outputted from demultiplexing section 101 and LPC coefficients outputted from second switching section 701 and outputs the calculated reduction information to multiplier 704. Reduction information calculating section 703 will be described in detail later.

Multiplier 704 multiplies the decoded spectrum outputted from switching section 105 by the reduction information outputted from reduction information calculating section 703, and outputs the decoded spectrum multiplied by the reduction information to time domain transforming section 407.

Figure 16:
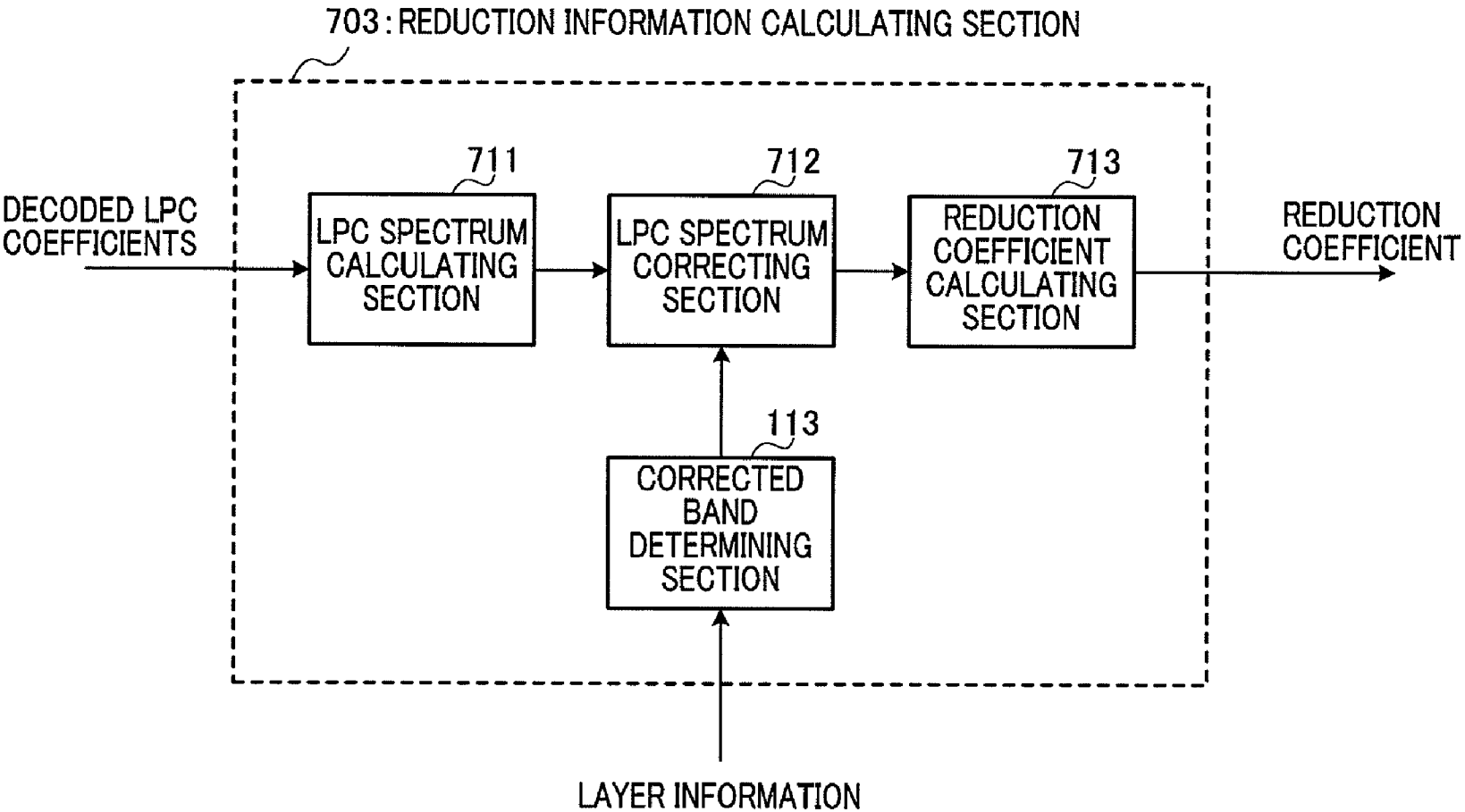
FIG. 16 is a block diagram showing an internal configuration of the reduction information calculating section shown in FIG. 15.

FIG. 16 is a block diagram showing an internal configuration of reduction information calculating section 703 shown in FIG. 15. In this figure, LPC spectrum calculating section 711 subjects the decoded LPC coefficients outputted from second switching section 701, to discrete Fourier transform, calculates the energy of each complex spectrum and outputs the calculated energy to spectrum correcting section 712 as an LPC spectrum. That is, when the decoded LPC coefficients are represented by $\alpha(i)$, a filter represented by following equation 2 is formed.

(Equation 2)

$$P(z) = \frac{1}{A(z)} = \frac{1}{1 - \sum_{i=1}^{NP} \alpha(i) \cdot z^{-i}} \quad [2]$$

LPC spectrum calculating section 711 calculates the spectral characteristics of the filter represented by above equation 2 and outputs the result to LPC spectrum correcting section 712. Here, NP is the order of the decoded LPC coefficients.

Further, the spectral characteristics of a filter may be calculated ($0<\gamma_n<\gamma_d<1$) by forming this filter represented by following equation 3 using predetermined parameters $\gamma_n$ and $\gamma_d$ for adjusting the degree of reducing noise.

(Equation 3)

$$P(z) = \frac{A(z/\gamma_n)}{A(z/\gamma_d)} = \frac{1 - \sum_{i=1}^{NP} \alpha(i) \cdot \gamma_n^i \cdot z^{-i}}{1 - \sum_{i=1}^{NP} \alpha(i) \cdot \gamma_d^i \cdot z^{-i}} \quad [3]$$

Further, although cases might occur where the filters represented by equation 2 and equation 3 have characteristics that a lower band (or higher band) is excessively emphasized compared to a higher band (or lower band) (these characteristics are generally referred to as "spectral tilt"), a filter (anti-tilt filter) for compensating for the characteristics may be used together.

Similar to power spectrum correcting section 114, LPC spectrum correcting section 712 corrects the LPC spectrum outputted from LPC spectrum calculating section 711, based on corrected band information outputted from corrected band determining section 113, and outputs the corrected LPC spectrum to reduction coefficient calculating section 713.

Reduction coefficient calculating section 713 may calculate a reduction coefficient based on the method described in Embodiment 4 or based on the following method. That is, reduction coefficient calculating section 713 divides the corrected LPC spectrum outputted from LPC spectrum correcting section 712 into subbands of a predetermined bandwidth and finds an average value per divided subband. Then, reduction coefficient calculating section 713 finds the subband having the maximum average value out of the subbands and normalizes the average value of each subband using the average value of the subband. The average values of the subbands after normalization are outputted as reduction coefficients.

Although a method has been described of outputting the reduction coefficient after division into predetermined subbands, reduction coefficients may be calculated and outputted per frequency in order to determine the reduction coefficients more specifically. In this case, reduction coefficient calculating section 713 finds the maximum frequency out of corrected LPC spectra outputted from LPC spectrum correcting section 712 and normalizes the spectrum of each frequency using the spectrum of this frequency. The spectra after normalization are outputted as reduction coefficients.

In this way, according to Embodiment 6, an LPC spectrum calculated from decoded LPC coefficients shows only a spectral envelope from which details of the decoded signal are removed, and a more accurate post filter can be realized by a smaller amount of calculation by directly finding a reduction coefficient based on this spectral envelope, so that it is possible to improve speech quality.

Embodiment 7

In Embodiment 7 of the present invention, a case will be described with two layered coding (scalable coding and embedded coding) as an example where layer 1 and layer 2 support signal bands and speech quality shown in FIG. 17. Layer 1 processes the lower band (where frequency k is equal to or more than 0 and less than FL) and layer 2 processes the higher band (where frequency k is equal to or more than FL and less than FH). The degree of bit distribution is greater in layer 1 than in layer 2, and so layer 1 realizes improved quality and layer 2 realizes standard quality.

Figures 17, 18:
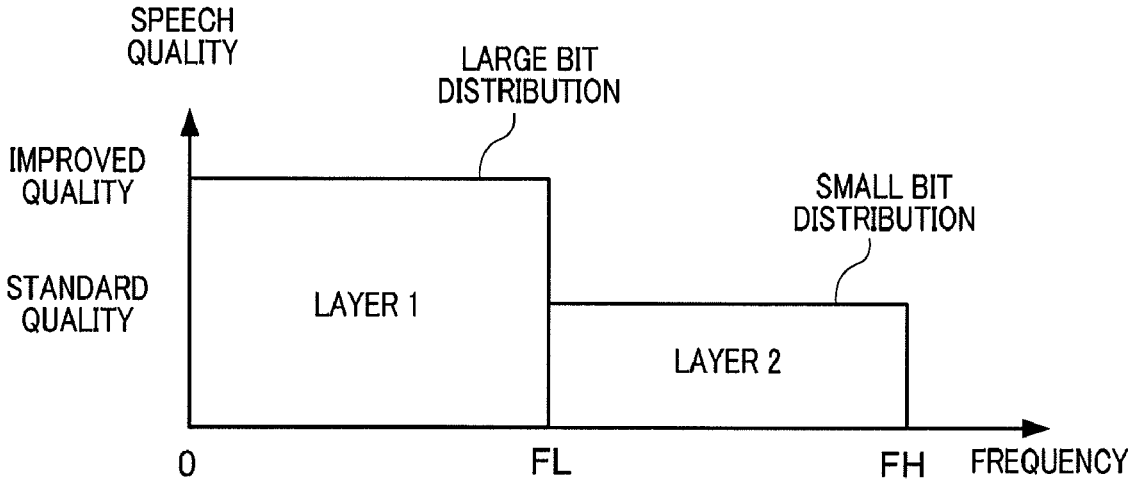
FIG. 17 shows a layer configuration of scalable coding.
FIG. 18 shows the degree of post filtering.

FIG. 18 shows the degree of post filtering required in this layer configuration. That is, layer 1 realizes quality improvement in the lower band and so it is not necessary to carry out post filtering in the lower band. On the other hand, layer 2 realizes only standard quality in the higher band and so it is necessary to set the degree of post filtering in the higher band "high."

In this embodiment, a coding scheme is assumed for encoding in the frequency domain an LPC prediction residual signal obtained by filtering an input signal by this inverse filter formed with LPC coefficients.

Figure 19:
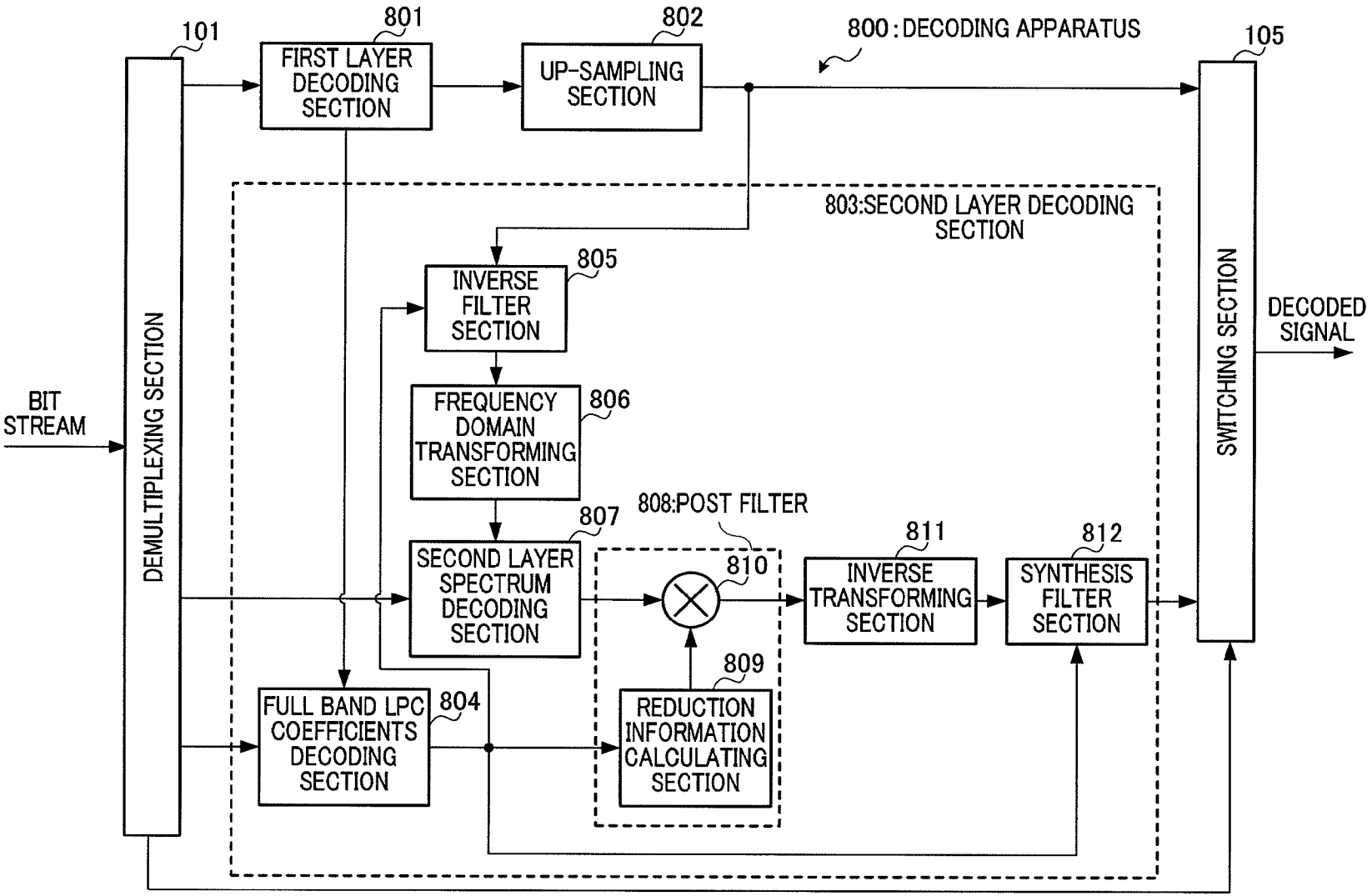
FIG. 19 is a block diagram showing a main configuration of the decoding apparatus according to Embodiment 7 of the present invention.

FIG. 19 is a block diagram showing a main configuration of decoding apparatus 800 according to Embodiment 7 of the present invention. In this figure, demultiplexing section 101 receives a bit stream sent out from a coding apparatus (not shown), generates a first layer encoded code, second layer encoded code (full band prediction residual spectrum) and second layer coding spectrum (full band LPC coefficients) from the received bit stream, outputs the first layer encoded code to first layer decoding section 801, outputs the second encoded code (full band prediction residual spectrum) to second layer spectrum decoding section 807 and outputs the second layer encoded code (full band LPC coefficients) to full band LPC coefficient decoding section 804.

First layer decoding section 801 generates a first layer decoded signal of improved quality where signal band k is equal to or more than 0 and less than FL, using the first layer encoded code outputted from demultiplexing section 101, and outputs the generated first layer decoded signal to up-sampling section 802. Further, first layer decoding section 801 generates decoded LPC coefficients in the process of generating the first layer decoded signal and outputs the generated decoded LPC coefficients to full band LPC coefficient decoding section 804.

Up-sampling section 802 increases the sampling rate for the first layer decoded signal outputted from first layer decoding section 801 and outputs the up-sampled signal to inverse filter section 805 and switching section 105.

Full band LPC coefficient decoding section 804 decodes the second layer encoded code (full band LPC coefficients)

outputted from demultiplexing section 101 using the decoded LPC coefficients outputted from first layer decoding section 801 and outputs the decoded full band LPC coefficients to inverse filter 805, reduction information calculating section 809 and synthesis filter section 812. Further, the "full band" refers to the band where frequency k is equal to or more than 0 and less than FH and the "decoded full band LPC coefficients" refer to the spectral envelope of the full band.

Inverse filter section 805 forms an inverse filter with the decoded full band LPC coefficients outputted from full band LPC coefficient decoding section 804, generates a prediction residual signal using the first layer decoded signal outputted from up-sampling section 802 to this inverse filter and outputs the generated prediction residual signal to frequency domain transforming section 806. Inverse filter A(z) is represented by the following equation using LPC coefficients α(i).

(Equation 4)

$$A(z) = 1 - \sum_{i=1}^{NP} \alpha(i) \cdot z^{-i} \quad [4]$$

Here, NP is the order of the LPC coefficients. Further, in order to control the degree of the inverse filter, filtering may be carried out by forming an inverse filter represented by the following equation using parameter $\gamma_a$ ($0<\gamma_a<1$).

(Equation 5)

$$A(z) = 1 - \sum_{i=1}^{NP} \alpha(i) \cdot \gamma_a^i \cdot z^{-i} \quad [5]$$

Frequency domain transforming section 806 analyzes the frequency of the prediction residual signal outputted from inverse filter section 805, finds the spectrum of the prediction residual signal (prediction residual spectrum) and outputs the prediction residual spectrum to second layer spectrum decoding section 807.

When demultiplexing section 101 outputs a second layer encoded code (full band prediction residual spectrum), second layer spectrum decoding section 807 decodes the second layer encoded code (full band prediction residual spectrum) using the prediction residual spectrum outputted from frequency domain transforming section 806. The generated full band prediction residual spectrum is outputted to post filter 808.

Post filter 808 has reduction information calculating section 809 and multiplier 810. Reduction information calculating section 809 calculates reduction information based on the decoded full band LPC coefficients outputted from full band LPC coefficient decoding section 804 and outputs the calculated reduction information to multiplier 810. Reduction information calculating section 809 will be described in detail later.

Multiplier 810 multiplies the full band prediction residual spectrum outputted from second layer spectrum decoding section 807 by the reduction information outputted from reduction information calculating section 809 and outputs the full band prediction residual spectrum multiplied by the reduction information to inverse transforming section 811.

Inverse transforming section 811 inverse transforms the full band prediction residual spectrum outputted from post filter 808 and finds a full band prediction residual signal. The full band prediction residual signal is outputted to synthesis filter section 812.

Synthesis filter section 812 forms a synthesis filter with the decoded full band LPC coefficients outputted from full band LPC coefficient decoding section 804, generates a full band decoded signal using the full band prediction residual signal outputted from inverse transforming section 811 to this synthesis filter and outputs the generated full band decoded signal to switching section 105. Synthesis filter H(z) is represented by the following equation using inverse filter A(z).

(Equation 6)

$$H(z) = \frac{1}{A(z)} \quad [6]$$

In this way, according to decoding apparatus 800, when layer information shows layer 1, second layer decoding section 803 does not operate, first layer decoding section 801 operates and post filtering is not carried out. Further, when the layer information shows layer 2, first layer decoding section 801 and second layer decoding section 803 operate and the post filter carries out the high degree of processing in the higher band. That is, the post filter functions when second layer decoding section 803 operates and so the layer information needs not to be outputted to the post filter.

Figure 20:
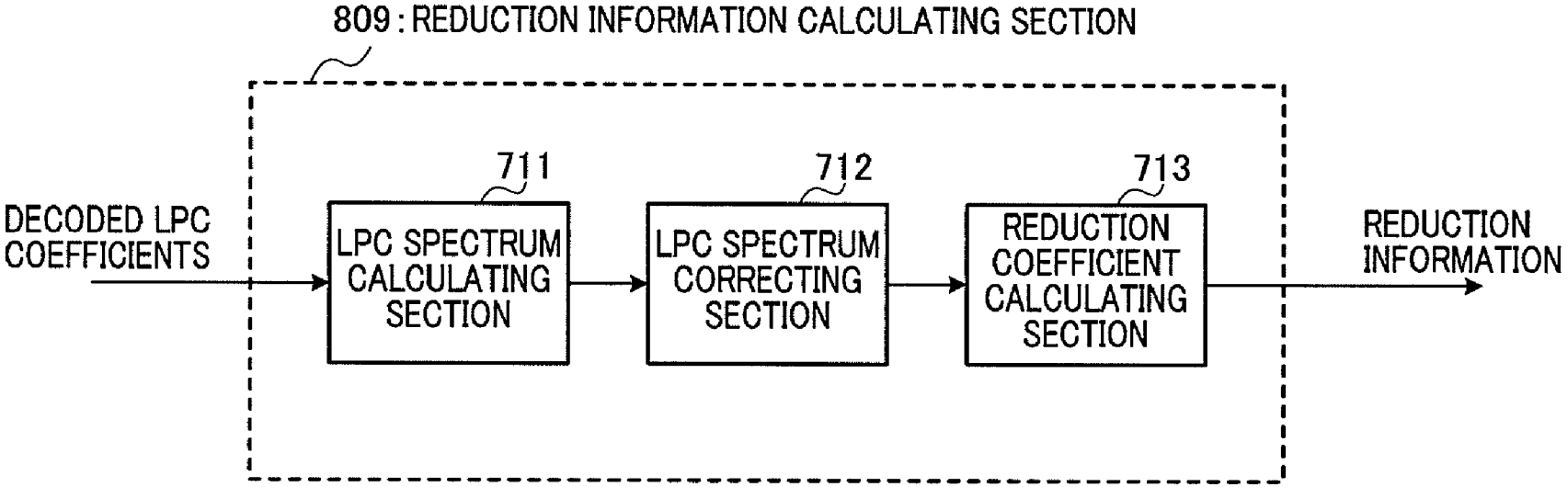
FIG. 20 is a block diagram showing an internal configuration of the reduction information calculating section shown in FIG. 19.

FIG. 20 is a block diagram showing an internal configuration of reduction information calculating section 809 shown in FIG. 19. The internal configuration of reduction information calculating section 809 removes corrected band determining section 113 from the internal configuration of reduction information calculating section 703 shown in FIG. 16, the other configurations are the same as in reduction information calculating section 703 and detailed description will be omitted.

In this way, according to Embodiment 7, even when layered coding by two layers of layer 1 for processing the lower band and layer 2 for processing the higher band is carried out, it is possible to realize a more accurate post filter by a smaller amount of calculation by directly finding the reduction coefficient based on a spectral envelope, so that it is possible to improve speech quality.

Further, although a case has been described with this embodiment where post filtering is carried out in second layer decoding section 803, the present invention is not limited to this and post filtering for improving quality in the lower band (where frequency k is equal to more than 0 and less than FL) may be carried out in first layer decoding section 801. In this case, it is possible to make speech quality in the lower band high quality (improved quality or speech quality equaling this high quality) by carrying out post filtering in the lower band. Accordingly, it is possible to improve speech quality in the lower band and the higher band, that is, the full band, by carrying out post filtering both in first layer decoding section 801 and second layer decoding section 803.

Other Embodiment

Although cases have been described with the above embodiments assuming scalable coding, a case will be described here where a coding scheme other than scalable coding is applied. In this case, bit distribution information showing the degree of bit distribution is used instead of layer information.

Figure 21:
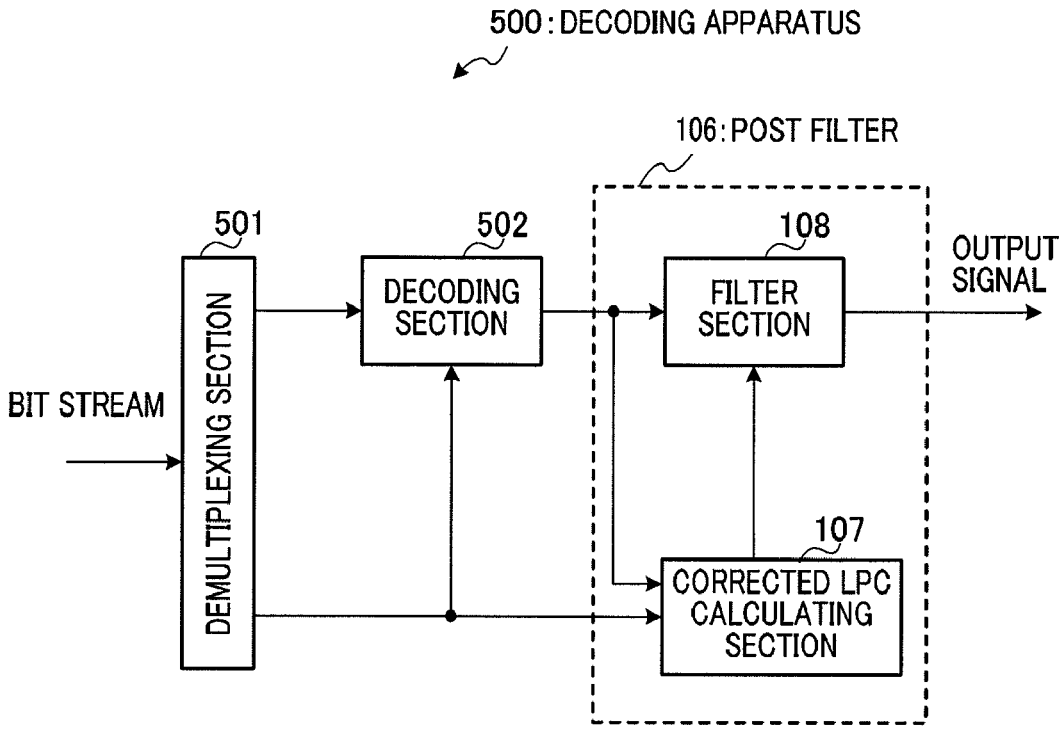
FIG. 21 is a block diagram showing a main configuration of the decoding apparatus according to another embodiment of the present invention.

FIG. 21 shows a configuration of decoding apparatus 500 corresponding to Embodiment 1. As shown in this figure, a bit stream is separated into encoded code and bit distribution information in demultiplexing section 501, the separated encoded code is outputted to decoding section 502 and the separated bit distribution information is outputted to decoding section 502 and corrected LPC calculating section 107.

The encoded code is decoded in decoding section 502 based on the bit distribution information, and the decoded signal is outputted to corrected LPC calculating section 107 and filter section 108.

Figure 22:
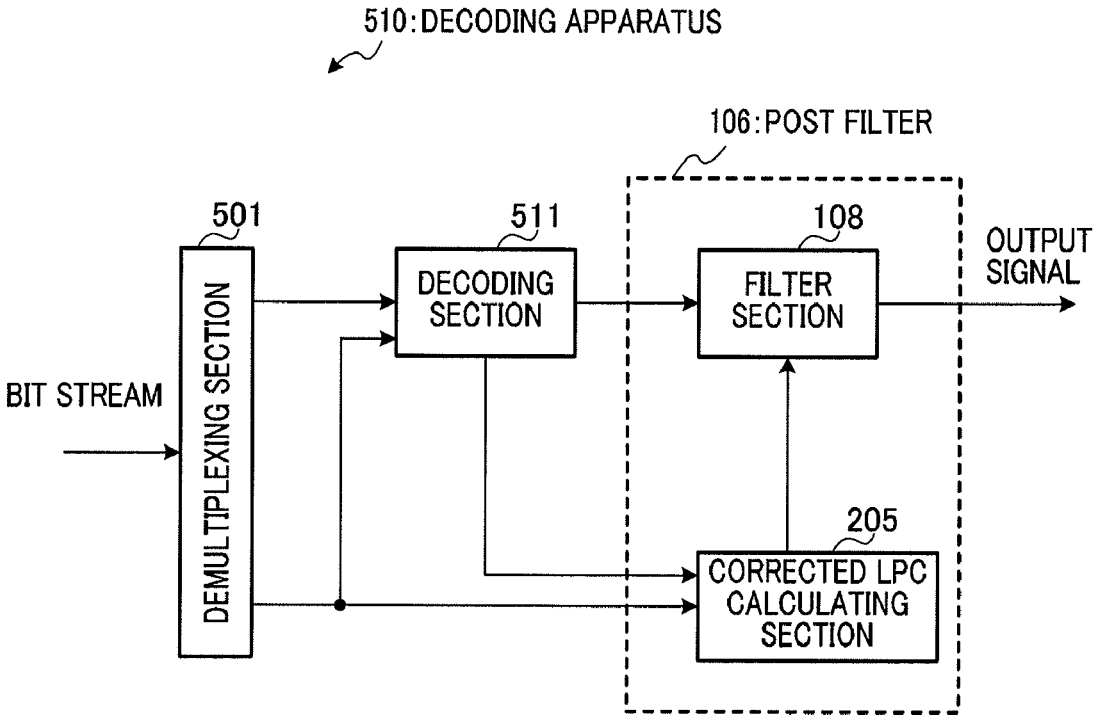
FIG. 22 is a block diagram showing a main configuration of the decoding apparatus according to another embodiment of the present invention.

Further, FIG. 22 shows a configuration of decoding apparatus 510 corresponding to Embodiment 2. As shown in this figure, decoding section 511 generates decoded LPC coefficients in the process of decoding the encoded code and outputs the generated decoded LPC coefficients to corrected LPC calculating section 205. Further, the decoded signal is outputted to filter section 108.

Figure 23:
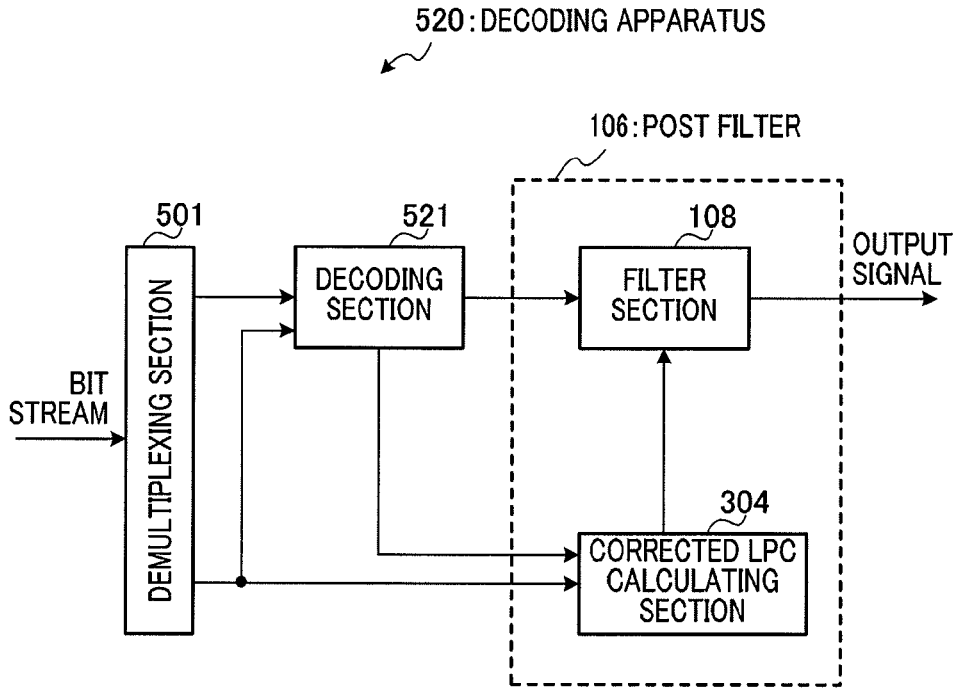
FIG. 23 is a block diagram showing a main configuration of the decoding apparatus according to another embodiment of the present invention.

Further, FIG. 23 shows a configuration of decoding apparatus 520 corresponding to decoding apparatus 300 of Embodiment 3. As shown in this figure, decoding section 521 generates a decoded spectrum in the process of decoding the encoded code and outputs the generated decoded spectrum to corrected LPC calculating section 304. Further, the decoded signal is outputted to filter section 108.

Figure 24:
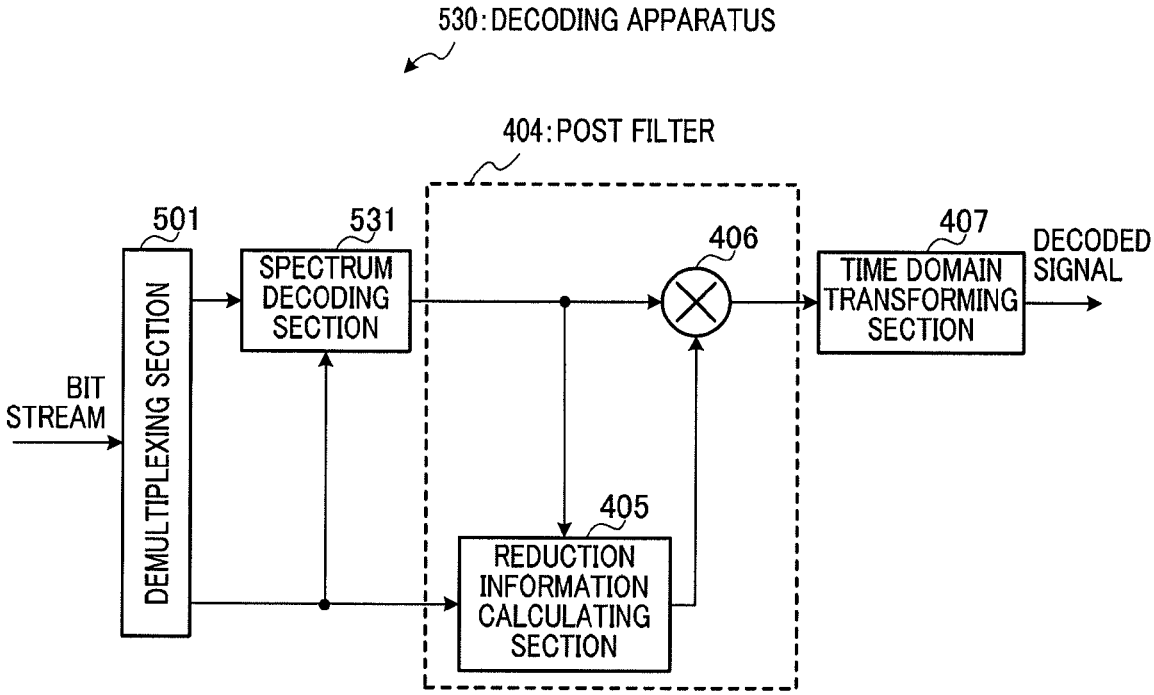
FIG. 24 is a block diagram showing a main configuration of the decoding apparatus according to another embodiment of the present invention.

Moreover, FIG. 24 shows a configuration of decoding apparatus 530 corresponding to decoding apparatus 400 of Embodiment 4. As shown in this figure, spectrum decoding section 531 generates a decoded spectrum from the encoded code and outputs the generated decoded spectrum to reduction information calculating section 405 and multiplier 406.

Further, although a case has been described with this embodiment where a band in which the spectrum is corrected is determined based on the bit distribution information, a band in which the spectrum is corrected may be determined in advance.

Embodiments of the present invention have been described.

Further, the frequency transforming sections in the above embodiments are realized by FFT, DFT (Discrete Fourier Transform), DCT (Discrete Cosine Transform), MDCT and subband filters.

Moreover, although cases have been described with the above embodiments where speech signals are assumed as decoded signals, the present invention is not limited to this, and, for example, audio signals may be possible.

Also, although cases have been described with the above embodiment as examples where the present invention is configured by hardware. However, the present invention can also be realized by software.

Each function block employed in the description of each of the aforementioned embodiments may typically be implemented as an LSI constituted by an integrated circuit. These may be individual chips or partially or totally contained on a single chip. "LSI" is adopted here but this may also be referred to as "IC", "system LSI", "super LSI", or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The present application is based on Japanese Patent Application No. 2005-177781, filed on Jun. 17, 2005, and Japanese Patent Application No. 2006-150356, filed on May 30, 2006, the entire contents of which are expressly incorporated by reference herein.

INDUSTRIAL APPLICABILITY

The post filter, decoding apparatus and post filtering method according to the present invention can improve speech quality of decoded signals even when speech quality of decoded signals vary between bands and can be applied to, for example, a speech decoding apparatus and the like.

The invention claimed is:

1. A post filter that reduces quantization noise in a decoded signal of a signal subjected to layered coding according to a coding scheme providing a plurality of layers, the post filter comprising:

a band determiner that selects among frequency bands of the decoded signal a first frequency band corresponding to a layer which is not used for coding among the plurality of layers and a second frequency band different from the first frequency band;

a spectrum corrector that corrects, for defining a corrected spectrum, a first spectrum corresponding to the second frequency band such that changes of the first spectrum in a frequency domain are reduced more than changes of a second spectrum corresponding to the first frequency band; and a filter, being one of a circuit and a processor, that filters the decoded signal using a coefficient derived from the corrected spectrum.

2. The post filter according to claim 1, wherein the spectrum corrector corrects the first spectrum corresponding to the second frequency band such that the corrected spectrum and the second spectrum are continuous.

3. The post filter according to claim 1, wherein the spectrum corrector corrects a power spectrum corresponding to the second frequency band by replacing the power spectrum with an average value of the power spectrum.

4. The post filter according to claim 1, wherein the spectrum corrector corrects a power spectrum corresponding to the second frequency band by replacing the power spectrum with a spectral tilt of the power spectrum.

5. The post filter according to claim 1, wherein the spectrum corrector calculates a linear prediction coefficient spectrum from decoded linear prediction coefficients generated in a process of decoding the signal subjected to layered coding, and corrects the calculated linear prediction coefficient spectrum.

6. The post filter according to claim 1, wherein the spectrum corrector calculates a power spectrum from a decoded spectrum generated in a process of decoding the signal subjected to layered coding, and corrects the power spectrum.

7. The post filter according to claim 1, further comprising a reduction coefficient calculator that calculates a reduction coefficient for reducing a spectrum of the decoded signal based on a power spectrum corrected by the spectrum corrector, wherein the filter filters the decoded signal in the frequency domain by multiplying the spectrum of the decoded signal by the reduction coefficient.

8. The post filter according to claim 1, comprising:

an inverse transformer that calculates an auto correlation function by subjecting a power spectrum corrected by the spectrum corrector to inverse Fourier transform; and a linear prediction coefficients analyzer that calculates linear prediction coefficients using the auto correlation function, wherein the filter filters the decoded signal using the linear prediction coefficients.

9. The post filter according to claim 8, wherein, when an order of the power spectrum corrected by the spectrum corrector cannot be represented by a power of two, the inverse transformer one of averages the power spectrum corrected by the spectrum corrector and carries out inverse fast Fourier transform by decimating the power spectrum corrected by the spectrum corrector such that the order becomes the power of two.

10. The post filter according to claim 1, wherein the second frequency band of the decoded signal has a quality greater than the first frequency band of the decoded signal.

11. The post filter according to claim 1, wherein the second frequency band of the decoded signal has a quality greater than a predetermined standard.

12. The post filter according to claim 1, wherein the spectrum corrector does not correct the second spectrum corresponding to the first frequency band.

13. The post filter according to claim 1, further comprising:

a separator that receives a bit stream generated by the coding scheme and separates a coding code stored in the bit stream and layer information, wherein the band determiner determines the first frequency band and the second frequency band based on the layer information.

14. A decoding apparatus that reduces quantization noise in a decoded signal of a signal subjected to layered coding according to a coding scheme providing a plurality of layers, the decoding apparatus comprising:

a band determiner that selects among frequency bands of the decoded signal a first frequency band corresponding to a layer which is not used for coding among the plurality of layers and a second frequency band different from the first frequency band;

a spectrum corrector that corrects, for defining a corrected spectrum, a first spectrum corresponding to the second frequency band such that changes of the first spectrum in a frequency domain are reduced more than changes of a second spectrum corresponding to the first frequency band; and a filter, being one of a circuit and a processor, that filters the decoded signal using a coefficient derived from the corrected spectrum.

15. A post filtering method of reducing quantization noise in a decoded signal of a signal subjected to layered coding according to a coding scheme providing a plurality of layers, the post filtering method comprising:

selecting, among frequency bands of the decoded signal, a first frequency band corresponding to a layer which is not used for coding among the plurality of layers and a second frequency band different from the first frequency band;

correcting, for defining a corrected spectrum, a first spectrum corresponding to the second frequency band such that changes of the first spectrum in a frequency domain are reduced more than changes of a second spectrum corresponding to the first frequency band; and filtering, with one of a processor and a circuit, the decoded signal using a coefficient derived from the corrected spectrum.

* * * * *